US010252543B2

(12) United States Patent
Uryu et al.

(10) Patent No.: US 10,252,543 B2
(45) Date of Patent: Apr. 9, 2019

(54) THERMAL PRINTER

(71) Applicant: FUJITSU COMPONENT LIMITED, Tokyo (JP)

(72) Inventors: Natsumi Uryu, Tokyo (JP); Hiroyuki Kataoka, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 6 days.

(21) Appl. No.: 15/623,769

(22) Filed: Jun. 15, 2017

(65) Prior Publication Data

US 2018/0009233 A1 Jan. 11, 2018

(30) Foreign Application Priority Data

Jul. 5, 2016 (JP) ..... 2016-133522

(51) Int. Cl.
*B41J 2/355* (2006.01)
*B41J 2/36* (2006.01)
*B41J 2/365* (2006.01)

(52) U.S. Cl.
CPC ..... *B41J 2/3555* (2013.01); *B41J 2/36* (2013.01); *B41J 2/365* (2013.01)

(58) Field of Classification Search
CPC ..... B41J 2/3555; B41J 2/36; B41J 2/42; B41J 2/362
See application file for complete search history.

(56) References Cited

U.S. PATENT DOCUMENTS

| | | | | |
|---|---|---|---|---|
| 5,142,302 | A | 8/1992 | Kano | |
| 5,644,351 | A * | 7/1997 | Matsumoto | B41J 2/3551 347/188 |
| 6,674,546 | B1 | 1/2004 | Nakahara | |
| 7,290,844 | B2 | 11/2007 | Takahashi et al. | |
| 8,144,365 | B2 | 3/2012 | Kita et al. | |
| 8,960,839 | B1 | 2/2015 | Mantell et al. | |
| 9,643,428 | B2 * | 5/2017 | Uryu | B41J 2/3555 |
| 2006/0158683 | A1 | 7/2006 | Gustafsson | |

(Continued)

FOREIGN PATENT DOCUMENTS

| | | |
|---|---|---|
| JP | S62-280055 | 12/1987 |
| JP | H04-220358 | 8/1992 |
| JP | 2001-277463 | 10/2001 |

(Continued)

OTHER PUBLICATIONS

Office Action dated Nov. 2, 2016 issued with respect to the related U.S. Appl. No. 15/090,816.

*Primary Examiner* — Thinh H Nguyen
(74) *Attorney, Agent, or Firm* — IPUSA, PLLC

(57) ABSTRACT

A thermal printer includes heating elements that generate heat according to amounts of applied energy, an energy applier that applies energy to the heating elements, a memory that stores a gradation table where energy levels to be applied to the heating elements are set for gradation levels based on a relationship between dot area ratios of an image and the amounts of energy applied to the heating elements, and a controller that transfers control data multiple times to the energy applier based on the gradation table to control the amounts of energy to be applied by the energy applier to the heating elements, each of the control data corresponding to different amounts of energy.

5 Claims, 19 Drawing Sheets

(56) References Cited

U.S. PATENT DOCUMENTS

| | | | |
|---|---|---|---|
| 2009/0309946 | A1 | 12/2009 | Saquib |
| 2013/0038657 | A1 | 2/2013 | Viturro et al. |

FOREIGN PATENT DOCUMENTS

| | | |
|---|---|---|
| JP | 2006-074668 | 3/2006 |
| JP | 2006-121153 | 5/2006 |
| JP | 2006-279152 | 10/2006 |
| JP | 2006-335009 | 12/2006 |

* cited by examiner

THERMAL PRINTER

CROSS-REFERENCE TO RELATED APPLICATION

The present application is based upon and claims the benefit of priority of Japanese Patent Application No. 2016-133522, filed on Jul. 5, 2016, the entire contents of which are incorporated herein by reference.

BACKGROUND OF THE INVENTION

1. Field of the Invention

An aspect of this disclosure relates to a thermal printer.

2. Description of the Related Art

A known thermal printer includes multiple heating elements that generate heat corresponding to the amounts of energy applied, and forms a multi-gradation image on a recording medium.

In such a thermal printer, gradation levels are determined based on a relationship, which is illustrated in FIG. 22, between the optical density of a printed image and the energy applied to the heating elements such that differences in optical density between the gradation levels become substantially the same, and the amounts of energy applied to the heating elements are set for the respective gradation levels.

Japanese Laid-Open Patent Publication No. 04-220358 discloses a thermal printer where the amounts of energy applied to heating elements are determined based on linear approximation of the relationship between the optical density of a printed image and energy applied to the heating elements in a medium density range, in order to reduce the processing load.

The relationship between the optical density and the reflectance indicating brightness of a printed image is represented by a formula below.

$$\text{Optical density} = -\log(\text{reflectance})$$

Accordingly, as illustrated in FIG. 23, the reflectance changes sharply in a low optical density range and changes gradually in a high optical density range. Therefore, even when the amounts of energy applied to heating elements so as the optical density changes at a constant interval as illustrated in FIG. 22, changes in reflectance in a high density range may become small and the gradation reproducibility may become low.

FIG. 24A illustrates an exemplary printed image printed by applying energy to heating elements at levels that are determined based on the relationship between the optical density and the energy illustrated in FIG. 22 such that changes in optical densities between gradation levels are substantially the same. FIG. 24B illustrates an exemplary printed image printed by applying energy to heating elements at levels that are determined based on linear approximation of the relationship between the optical density and the applied energy.

As illustrated in FIGS. 24A and 24B, when the amounts of energy applied to heating elements are determined based on the optical density, the reflectance of a printed image in the low density range sharply changes, but gradations of the printed image in the high density range become indiscernible. This in turn may practically reduce the number of reproducible gradation levels.

SUMMARY OF THE INVENTION

In an aspect of this disclosure, there is provided a thermal printer including heating elements that generate heat according to amounts of applied energy, an energy applier that applies energy to the heating elements, a memory that stores a gradation table where energy levels to be applied to the heating elements are set for gradation levels based on a relationship between dot area ratios of an image and the amounts of energy applied to the heating elements, and a controller that transfers control data multiple times to the energy applier based on the gradation table to control the amounts of energy to be applied by the energy applier to the heating elements, each of the control data corresponding to different amounts of energy.

DESCRIPTION OF EMBODIMENTS

Embodiments of the present invention are described below with reference to the accompanying drawings. The same reference number is assigned to the same components, and repeated descriptions of those components may be omitted.

First Embodiment

<Configuration of Thermal Printer>

Figure 1:
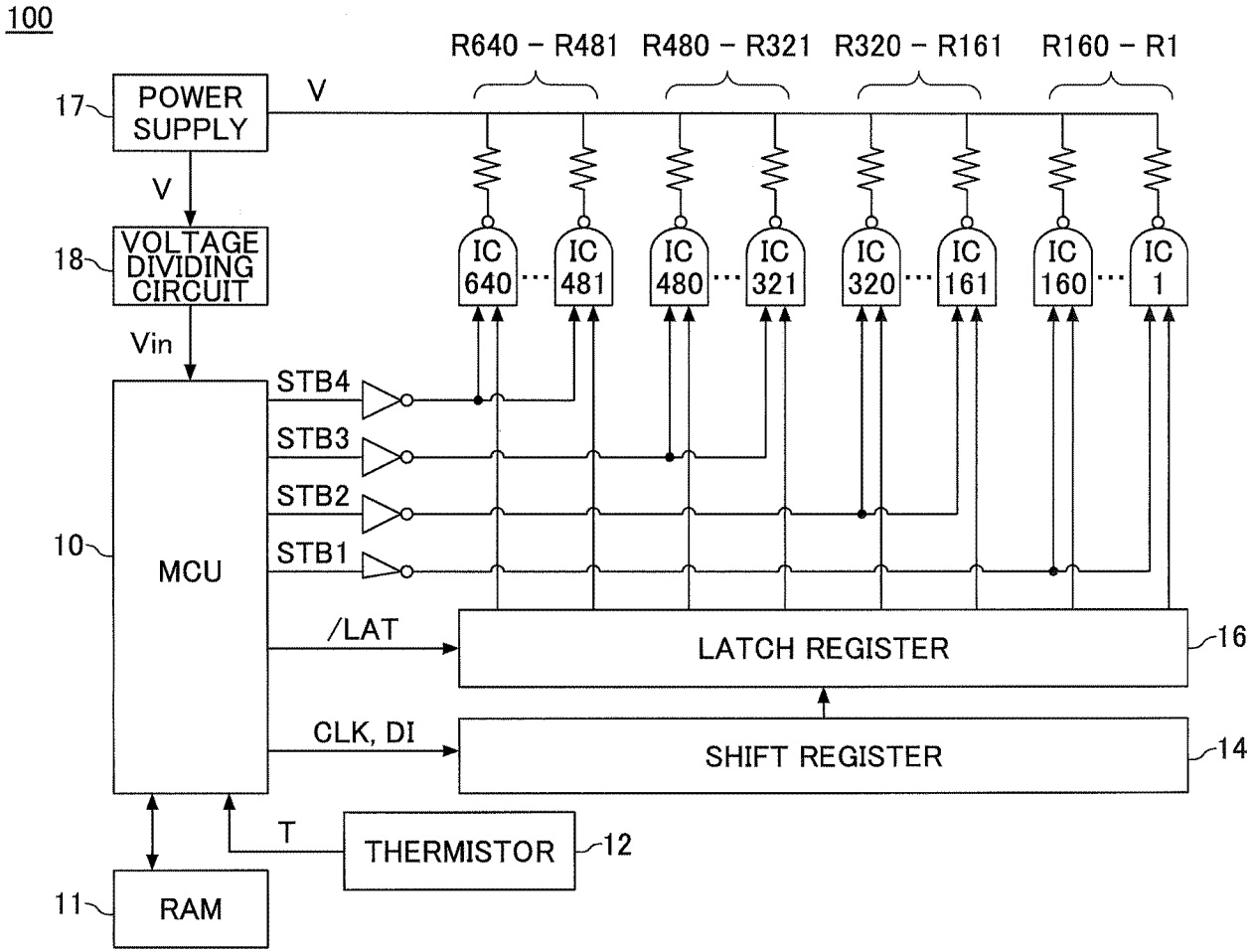
FIG. 1 is a drawing illustrating a thermal printer according to an embodiment.

FIG. 1 is a drawing illustrating an exemplary configuration of a thermal printer 100 according to an embodiment.

As illustrated in FIG. 1, the thermal printer 100 includes a micro control unit (MCU) 10, a random access memory (RAM) 11, a thermistor 12, a shift register 14, a latch register 16, a power supply 17, a voltage dividing circuit 18, integrated circuits (IC) 1-640, and heating elements R1-R640. The heating elements may be collectively referred to as "heating elements R".

The heating elements R are provided in a thermal head and arranged in a line along the main scanning direction. The respective heating elements R generate heat corresponding to the level of applied energy to heat a recording medium such as thermal paper and form an image on the recording medium. The thermal printer 100 can print 640 dots per print line on a recording medium.

The heating elements R are grouped into printing blocks corresponding to print areas, and the printing blocks are separately controlled. In the present embodiment, the heating elements R1-R640 are grouped into four printing blocks each including 160 heating elements: heating elements R1-R160, heating elements R161-R320, heating elements R321-R480, and heating elements R481-R640. The number of heating elements and the number of printing blocks are not limited to this example.

The MCU 10 is an example of a controller. The MCU 10 sets the amounts of energy to be applied to the heating elements R based on the gradation levels of an image to be printed, and sends various signals to the shift register 14, the latch register 16, and the ICs. The shift register 14, the latch register 16, the ICs, and the power supply 17 forms an energy applier for applying energy to the heating elements R.

The MCU 10 generates a DI signal for controlling the heating elements R based on image data input to the thermal printer 100 and a gradation table stored in the RAM 11, and sends the generated DI signal to the shift register 14 via a clock synchronous serial communication. After transmitting the DI signal for one print line to the shift register 14, the MCU 10 sends a /LAT signal to the latch register 16 to cause the latch register 16 to latch data in the shift register 14.

The RAM 11 is an example of a memory, and stores a gradation table that contains energy values corresponding to gradation levels.

The shift register 14 stores 640-bit data, and includes data areas each of which stores one bit of data. Each bit of the shift register 14 corresponds to one of the heating elements R. For example, bit 0 corresponds to the heating element R1, and bit 639 corresponds to the heating element R640. The data stored in the shift register 14 is used to control the heating elements. When a bit is 1, the corresponding heating element R is turned on; and when a bit is 0, the corresponding heating element R is turned off.

Similarly to the shift register 14, the latch register 16 includes data areas corresponding to the heating elements R. The latch register 16 latches signals sent from the shift register 14 when receiving the /LAT signal from the MCU 10. The signals latched by the latch register 16 are input to the ICs.

Each one of the ICs 1-640 is provided for, and is connected to the corresponding heating elements R1-R640. The ICs are turned on and off by STB signals. When an IC receives a signal "1" from the latch register 16 and receives an STB signal "ON" from the MCU 10, the IC supplies power to the corresponding heating element. Power is supplied to each heating element R while the STB signal is ON. That is, the power-supply period of each heating element R is controlled by the STB signal. The amount of energy supplied to each heating element R increases as the power-supply period increases.

The MCU 10 sends an STB signal for each of the printing blocks. The MCU 10 sends an STB1 signal to the ICs 1-160, an STB2 signal to the ICs 161-320, an STB3 signal to the ICs 321-480, and an STB4 signal to the ICs 481-640, to separately control the printing blocks.

The power supply 17 is connected to, and applies a voltage V to the heating elements R. The MCU obtains amount of the voltage V applied from the power supply 17 to the heating elements R based on a voltage Vin obtained by the voltage dividing circuit 18 by dividing the voltage V. The thermistor 12 is an example of a temperature detector, and measures a temperature of the thermal head where the heating elements R are provided, and sends measured temperature to the MCU 10.

<Gradation Table>

A gradation table used to control the energy to be applied to the heating elements R is described.

Figure 2:
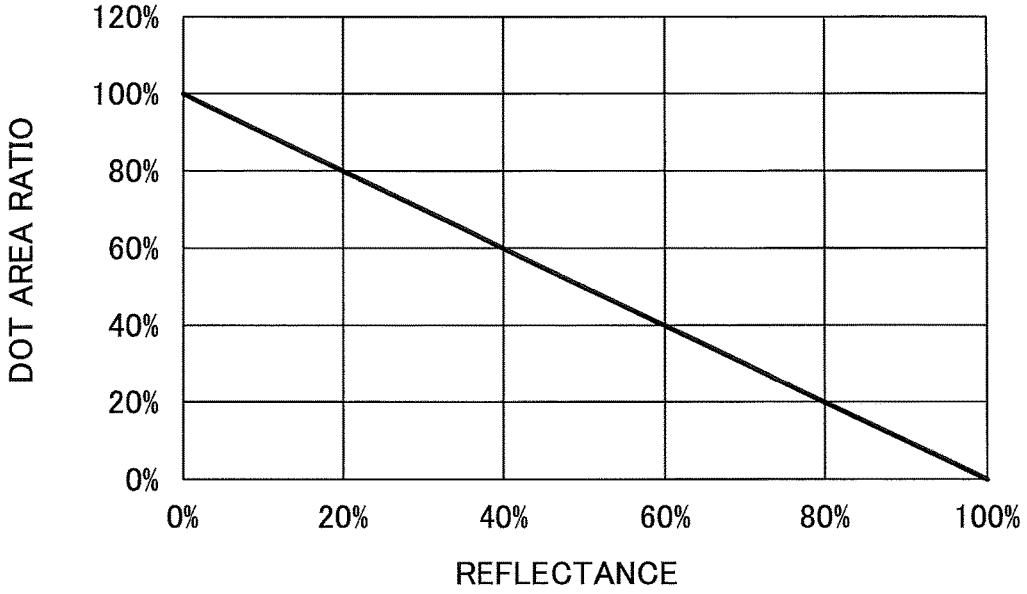
FIG. 2 is a graph illustrating a relationship between a dot area ratio and a reflectance of an image.

To reproduce smooth gradations of an image, a grayscale between white and black is divided based on reflectances. As illustrated in FIG. 2, the reflectance is proportional to the dot area ratio. The relationship between the dot area ratio and the optical density is represented by a Murray-Davies equation. When $D_0$ indicates the density of paper, $D_s$ indicates a saturation density, and $D_t$ indicates a printed-area density, dot area ratio A is represented by formula (1) below.

$$A[\%] = 100 \times \frac{(1 - 10^{-(D_t - D_0)})}{(1 - 10^{-(D_s - D_0)})} \quad (1)$$

Figure 3:
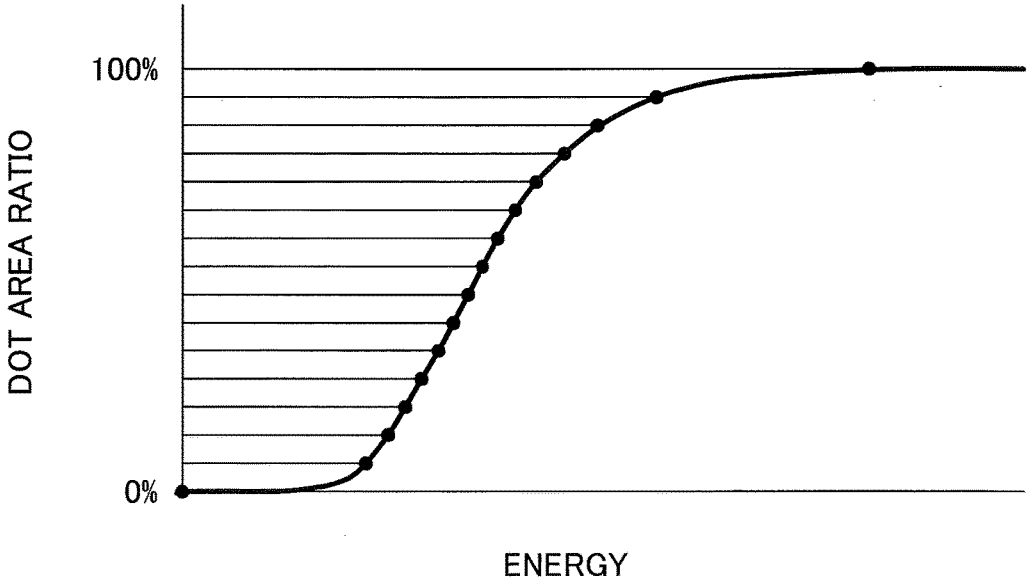
FIG. 3 is a graph illustrating a relationship between a dot area ratio and energy applied to heating elements.

In the present embodiment, gradation levels are determined based on a relationship between the energy applied to the heating element and the dot area ratio of an image as indicated by FIG. 3 such that differences in the dot area ratio between any two adjacent gradation levels become substantially the same, and energy values corresponding to the determined gradation levels are set. FIG. 3 illustrates an example of 16 gradation levels obtained by dividing a range between a dot area ratio of 0% (white) and 100% (black) into 15 equal parts, and energy values corresponding to the gradation levels.

Figure 4:
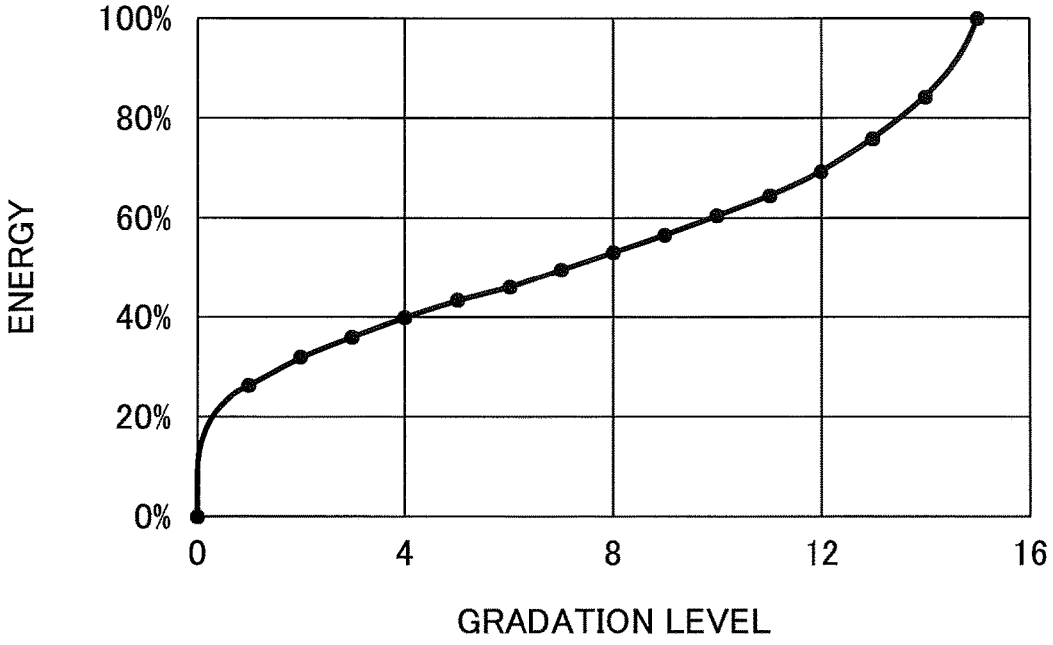
FIG. 4 is a graph illustrating a relationship between a gradation level and energy applied to heating elements.

FIG. 4 is a graph illustrating an exemplary relationship between 16 gradation levels and energy values derived from FIG. 3. In FIG. 4, an energy value of 100% corresponds to the energy value at the dot area ratio of 100% (the maximum gradation level) in FIG. 3. In the thermal printer 100, energy values representing the amounts of energy to be applied to the heating elements R for respective gradation levels are determined based on the relationship between the dot area ratio and the applied energy, and the determined energy values are stored in the RAM 11 as a gradation table. Table 1 is an example of the gradation table.

TABLE 1

| GRADATION LEVEL | ENERGY |
|---|---|
| 0 | 0.0% |
| 1 | 25.9% |
| 2 | 31.3% |
| 3 | 35.3% |
| 4 | 38.8% |
| 5 | 42.0% |
| 6 | 45.2% |
| 7 | 48.4% |
| 8 | 51.7% |
| 9 | 55.1% |
| 10 | 58.9% |
| 11 | 63.3% |
| 12 | 68.4% |
| 13 | 74.8% |
| 14 | 83.7% |
| 15 | 100.0% |

Storing energy values for respective gradation levels in advance as a gradation table eliminates the need to calculate an energy value corresponding to a gradation level of an image to be printed based on a relationship between gradation levels and energy values.

Table 1 includes gradation levels 0-15 used to print a 16-gradation-level image. However, depending on the number of gradation levels of image data to be printed, a different gradation table with 4 gradation levels or 32 gradation levels may be stored in the RAM 11. Also, multiple gradation tables of different gradation levels may be stored. Table 2 is an example of a gradation table with 4 gradation levels. Table 3 is an example of a gradation table with 32 gradation levels.

TABLE 2

| GRADATION LEVEL | ENERGY |
|---|---|
| 0 | 0.0% |
| 1 | 42.0% |
| 2 | 59.0% |
| 3 | 100.0% |

TABLE 3

| GRADATION LEVEL | ENERGY |
|---|---|
| 0 | 0.0% |
| 1 | 21.7% |
| 2 | 25.7% |
| 3 | 28.6% |
| 4 | 31.0% |
| 5 | 33.0% |
| 6 | 34.9% |
| 7 | 36.7% |
| 8 | 38.3% |
| 9 | 39.9% |
| 10 | 41.5% |
| 11 | 43.0% |
| 12 | 44.6% |
| 13 | 46.1% |
| 14 | 47.6% |
| 15 | 49.2% |
| 16 | 50.8% |
| 17 | 52.4% |

TABLE 3-continued

| GRADATION LEVEL | ENERGY |
|---|---|
| 18 | 54.1% |
| 19 | 55.9% |
| 20 | 57.7% |
| 21 | 59.6% |
| 22 | 61.7% |
| 23 | 63.9% |
| 24 | 66.3% |
| 25 | 68.9% |
| 26 | 71.9% |
| 27 | 75.3% |
| 28 | 79.2% |
| 29 | 84.1% |
| 30 | 90.5% |
| 31 | 100.0% |

When printing image data of 16 gradation levels, the MCU 10 sets the amounts of energy to be applied to the heating elements R based on Table 1. The MCU 10 controls the energy value to be applied to each of the heating elements R by changing the time period for supplying power to each heating element.

Figure 5A:
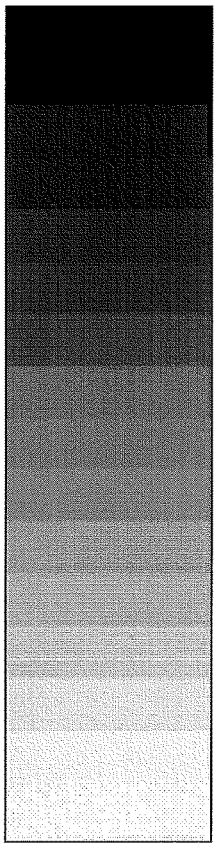
FIGS. 5A through 5C are examples of original image data and printed images.
Figure 5B:
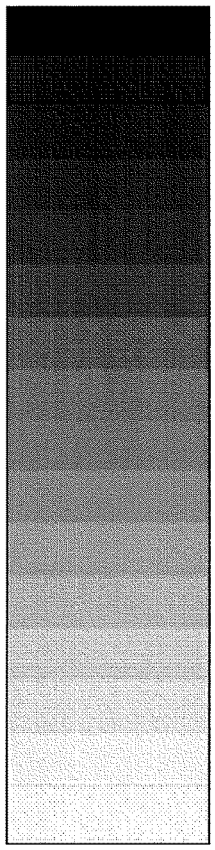

FIG. 5A illustrates an example of original image data input to the thermal printer 100. The original image data has 16 gradation levels that are proportional to the dot area ratio. FIG. 5B illustrates an example of a printed image obtained by printing the original image data of FIG. 5A based on Table 1.

As illustrated in FIG. 5B, by setting the amounts of energy to be applied to the heating elements R based on the dot area ratio, gradations in the high density range become clear and gradations of the original image data can be reproduced from the low density range to the high density range. Also, differences in reflectance between the gradation levels are substantially the same, and smooth gradations are reproduced. Thus, a high-quality image with excellent reproduction of gradations is obtained.

Figure 6:
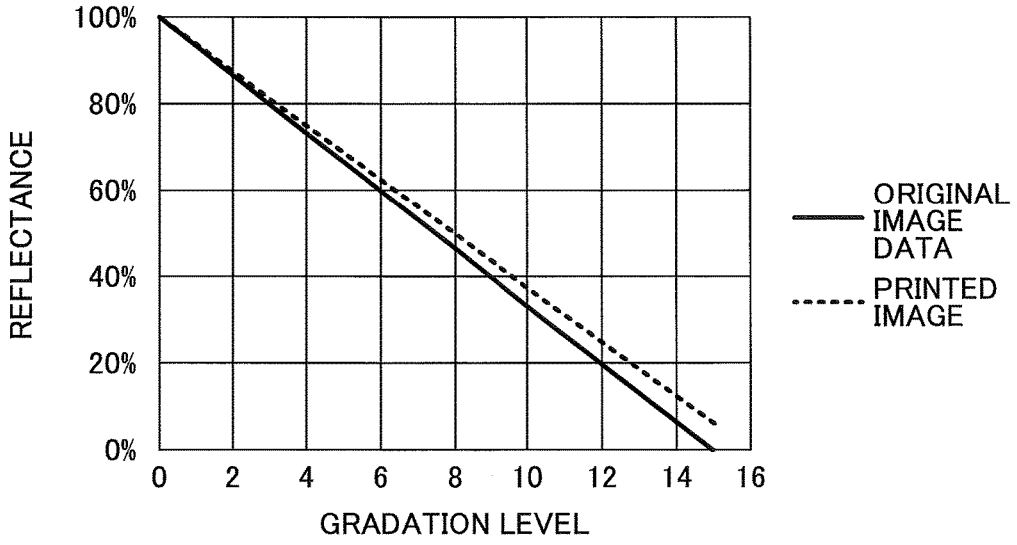
FIG. 6 is a graph illustrating a relationship between a gradation level and a reflectance in each of original image data and a printed image.

FIG. 6 is a graph illustrating a relationship between the gradation level and the reflectance in the original image data of FIG. 5A and the printed image of FIG. 5B. Assuming that the reflectance of a black color of an image (gradation level 15) is 1%, the optical density is 2.00. However, the optical density of a black color in an actually-printed image does not reach 2.00. In FIG. 6, if the saturation density is about 1.15, the reflectance of the black color at gradation level 15 becomes 7%. Therefore it is assumed that a condition where the corresponding reflectance is 7% corresponds to a dot area ratio of 100%.

As illustrated in FIG. 6, the reflectances of the printed image are also slightly higher than the reflectances of the original image data at other gradation levels. Therefore, an image may be printed using a gradation table where energy values for respective gradation levels are set, such that the reflectance of the printed image at each gradation level equals the reflectance of the original image data within a range of reflectance that is reproducible on a recording medium.

Figure 7:
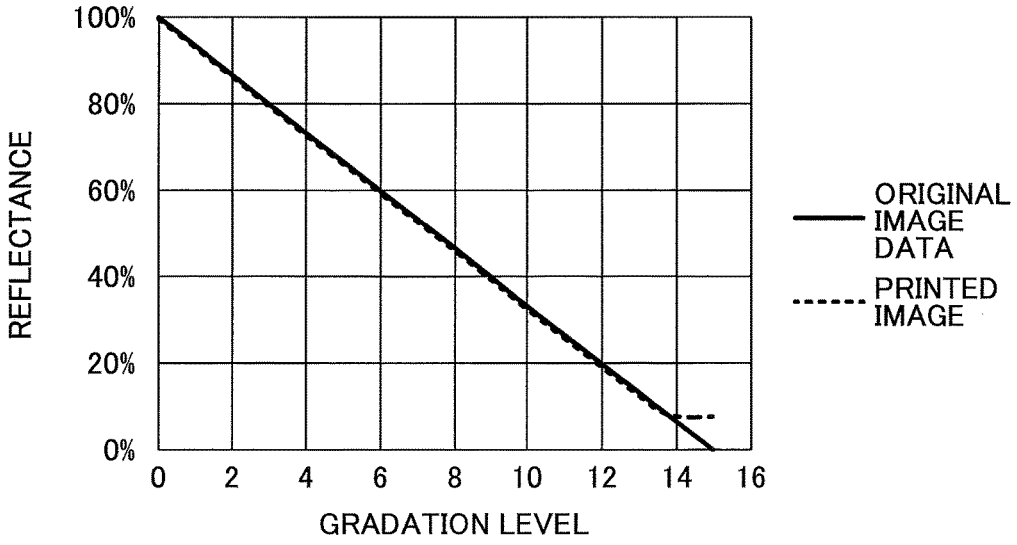
FIG. 7 is a graph illustrating a relationship between a gradation level and a reflectance in each of original image data and a printed image.

FIG. 7 is a graph illustrating a relationship between the gradation level and the reflectance in a case where such a gradation table is used. In FIG. 7, although the reflectance of the printed image at gradation level 15 (7%) is different from the reflectance of the original image data, the reflectances of the printed image and of the original image data are substantially the same at gradation levels 0 through 14. The gradation table stores energy values corresponding to the reflectances in FIG. 7 in association with each gradation level.

Figure 5C:
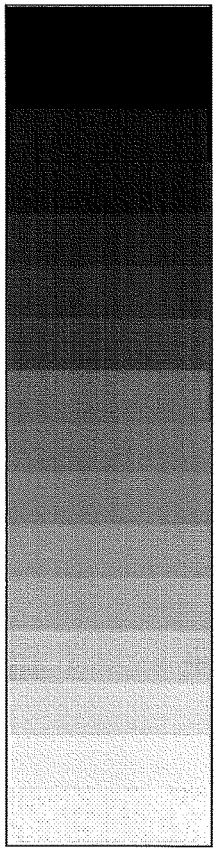

By using a gradation table where energy values are set such that the reflectance of original image data matches the reflectance of a printed image as illustrated in FIG. 7, the image in which its reflectance matches the reflectance of the original image data at each of gradation levels 0 through 14 can be printed. FIG. 5C illustrates an example of a printed image printed using this type of gradation table.

As described above, by using Table 1 for printing, the gradation reproducibility of a printed image at gradation levels 0 through 15 can be improved as illustrated in FIG. 5B. Further, by using a gradation table obtained by correcting Table 1, an image having the reflectance equals to the reflectance of original image data at each gradation level within a range of reflectance that is reproducible on a recording medium as illustrated in FIG. 5C can be printed.

The thermal printer 100 may be configured to store multiple gradation tables in the RAM 11, and to allow a user to select one of the gradation tables for printing. The user can print an image with desired gradation characteristics by selecting a gradation table suitable for the image to be printed.

Figure 8:
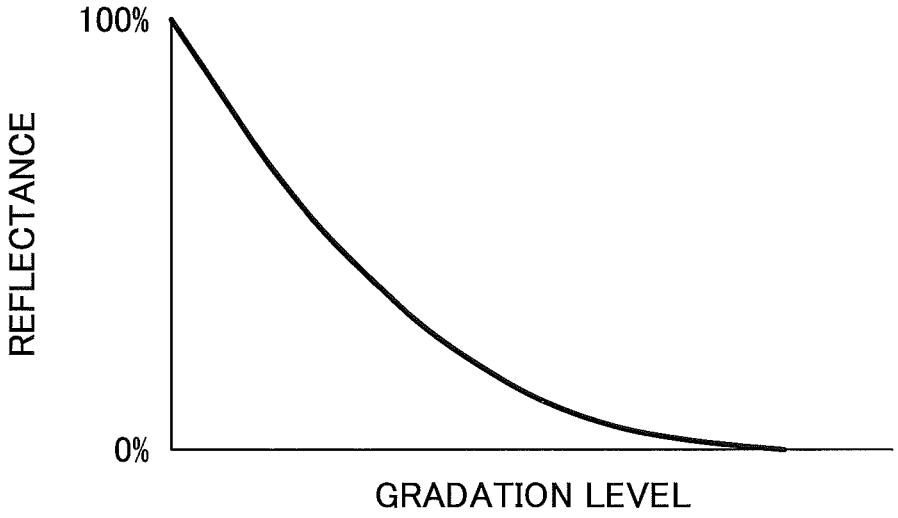
FIG. 8 is a graph illustrating a relationship between a gradation level and a reflectance.

The RAM 11 may store gradation tables with different numbers of gradation levels as exemplified by Tables 1-3, and/or gradation tables where the same number of gradation levels are defined but different energy values are specified for each of the gradation levels. Further, the RAM 11 may store a gradation table where energy values are set for gradation levels such that gradations are easily recognizable by human eyes, based on a relationship between the gradation level and the reflectance of an image expressed by a logarithmic function (FIG. 8) like the relationship between the Munsell value and the reflectance. The MCU 10 controls the energy applied to the heating elements R based on a gradation table selected, for example, by a user.

<Data Transfer>

Next, a method of transferring control data for turning on and off the heating elements from the MCU 10 to the shift register 14 is described.

The MCU 10 transfers control data for controlling the heating elements to the shift register 14 so that energy corresponding to the gradation levels of image data is applied to each heating element.

For example, when printing a 16-gradation-level image by using Table 1, the MCU 10 transfers control data corresponding to gradation levels 1 through 15 for 15 times for each print line to apply energy corresponding to gradation levels to the respective heating elements R.

However, if the control data need to be transferred 15 times for each print line, a data transfer time for each line is 128 us when the data transfer rate of the MCU 10 is 5 MHz. Accordingly, when the resolution of image data is 200 dpi (8 dot/mm), the printing speed is reduced to 60 mm/sec.

In the present embodiment, the number of times data is transferred from the MCU 10 is reduced and the printing speed is increased by using a data transfer method described below.

Energy corresponding to 16 gradation levels can be applied to the heating elements R by setting energy levels 0 through 15 by dividing an energy range of 0% through 100% into 16 equal parts as indicated by Table 4, and a 16-gradation-level image can be printed by transferring control data only four times.

TABLE 4

| ENERGY LEVEL | DATA TRANSFER FIRST 53.3% | SECOND 26.7% | THIRD 13.3% | FOURTH 6.7% | ENERGY |
|---|---|---|---|---|---|
| 0 | OFF | OFF | OFF | OFF | 0.0% |
| 1 | OFF | OFF | OFF | ON | 6.7% |
| 2 | OFF | OFF | ON | OFF | 13.3% |
| 3 | OFF | OFF | ON | ON | 20.0% |
| 4 | OFF | ON | OFF | OFF | 26.7% |
| 5 | OFF | ON | OFF | ON | 33.3% |
| 6 | OFF | ON | ON | OFF | 40.0% |
| 7 | OFF | ON | ON | ON | 46.7% |
| 8 | ON | OFF | OFF | OFF | 53.3% |
| 9 | ON | OFF | OFF | ON | 60.0% |
| 10 | ON | OFF | ON | OFF | 66.7% |
| 11 | ON | OFF | ON | ON | 73.3% |
| 12 | ON | ON | OFF | OFF | 80.0% |
| 13 | ON | ON | OFF | ON | 86.7% |
| 14 | ON | ON | ON | OFF | 93.3% |
| 15 | ON | ON | ON | ON | 100.0% |

The MCU 10 transfers control data four times to the heating elements to apply energy with energy levels 0 through 15 corresponding to the gradation levels 0 through 15. The MCU 10 firstly sends first control data indicating ON or OFF of 53.3% energy, then sends second control data indicating ON or OFF of 26.7% energy, then sends third control data indicating ON or OFF of 13.3% energy, and finally sends fourth control data indicating ON or OFF of 6.7% energy.

If the heating element R1 is used to print an image of gradation level 7, energy of 46.7% corresponding to energy level 7 needs to be applied to the heating element R1. In this case, the MCU 10 sends the first control data (OFF), the second control data (ON), the third control data (ON), and the fourth control data (ON) for the heating element R1 based on Table 4. As a result, a total of 46.7% energy (26.7%+13.3%+6.7%) is applied to the heating element R1.

Thus, energy corresponding to gradation levels can be applied to the heating elements by transferring control data four times such that control data indicate ON and OFF of different amounts of energy. The data transfer described above can reduce the number of data transfer from the MCU 10 to the shift register 14 and enables high-speed printing.

In Table 1, the minimum difference between energy values set for two adjacent gradation levels is 3.2%. To support the minimum difference of 3.2%, an energy level table of Table 5 is set by dividing the energy range of 0% through 100% into 32 ($=2^5$) equal parts such that the energy difference between gradation levels becomes about 3.2%.

TABLE 5

| ENERGY LEVEL | ENERGY |
|---|---|
| 0 | 0.0% |
| 1 | 3.2% |
| 2 | 6.5% |
| 3 | 9.7% |
| 4 | 12.9% |
| 5 | 16.1% |
| 6 | 19.4% |
| 7 | 22.6% |
| 8 | 25.8% |
| 9 | 29.0% |
| 10 | 32.3% |
| 11 | 35.5% |
| 12 | 38.7% |
| 13 | 41.9% |

TABLE 5-continued

| ENERGY LEVEL | ENERGY |
|---|---|
| 14 | 45.2% |
| 15 | 48.4% |
| 16 | 51.6% |
| 17 | 54.8% |
| 18 | 58.1% |
| 19 | 61.3% |
| 20 | 64.5% |
| 21 | 67.7% |
| 22 | 71.0% |
| 23 | 74.2% |
| 24 | 77.4% |
| 25 | 80.6% |
| 26 | 83.9% |
| 27 | 87.1% |
| 28 | 90.3% |
| 29 | 93.5% |
| 30 | 96.8% |
| 31 | 100.0% |

With such energy level table, the energy values corresponding to the gradation levels in Table 1 can be associated with energy levels in Table 5 to set a gradation-energy table of Table 6. For example, 25.9% energy corresponding to gradation level 1 in Table 1 is close to 25.8% energy corresponding to energy level 8 in Table 5, and can be associated with energy level 8. Accordingly, a 16-gradation-level image can be printed by using energy values corresponding to the energy levels associated with the gradation levels.

TABLE 6

| GRADATION LEVEL | ENERGY | ENERGY LEVEL |
|---|---|---|
| 0 | 0.0% | 0 |
| 1 | 25.9% | 8 |
| 2 | 31.3% | 10 |
| 3 | 35.3% | 11 |
| 4 | 38.8% | 12 |
| 5 | 42.0% | 13 |
| 6 | 45.2% | 14 |
| 7 | 48.4% | 15 |
| 8 | 51.7% | 16 |
| 9 | 55.1% | 17 |
| 10 | 58.9% | 18 |

TABLE 6-continued

| GRADATION LEVEL | ENERGY | ENERGY LEVEL |
|---|---|---|
| 11 | 63.3% | 20 |
| 12 | 68.4% | 21 |
| 13 | 74.8% | 23 |
| 14 | 83.7% | 26 |
| 15 | 100.0% | 31 |

When energy values corresponding to gradation levels in a gradation table are associated with 32 (=25) energy levels, a 16-gradation-level image can be printed by transferring control data five times for each print line. For example, the MCU 10 transfers control data five times based on Table 7 to apply energy corresponding to the gradation levels to the heating elements R.

TABLE 7

| | DATA TRANSFER | | | | | | |
|---|---|---|---|---|---|---|---|
| GRADATION LEVEL | FIRST 51.6% | SECOND 25.8% | THIRD 12.9% | FOURTH 6.5% | FIFTH 3.2% | ENERGY LEVEL | ENERGY |
| 0 | OFF | OFF | OFF | OFF | OFF | 0 | 0.0% |
| 1 | OFF | ON | OFF | OFF | OFF | 8 | 25.8% |
| 2 | OFF | ON | OFF | ON | OFF | 10 | 32.3% |
| 3 | OFF | ON | OFF | ON | ON | 11 | 35.5% |
| 4 | OFF | ON | ON | OFF | OFF | 12 | 38.7% |
| 5 | OFF | ON | ON | OFF | ON | 13 | 41.9% |
| 6 | OFF | ON | ON | ON | OFF | 14 | 45.2% |
| 7 | OFF | ON | ON | ON | ON | 15 | 48.4% |
| 8 | ON | OFF | OFF | OFF | OFF | 16 | 51.6% |
| 9 | ON | OFF | OFF | OFF | ON | 17 | 54.8% |
| 10 | ON | OFF | OFF | ON | OFF | 18 | 58.1% |
| 11 | ON | OFF | ON | OFF | OFF | 20 | 64.5% |
| 12 | ON | OFF | ON | OFF | ON | 21 | 67.7% |
| 13 | ON | OFF | ON | ON | ON | 23 | 74.2% |
| 14 | ON | ON | OFF | ON | OFF | 26 | 83.9% |
| 15 | ON | ON | ON | ON | ON | 31 | 100.0% |

As indicated by Table 7, to apply energy corresponding to gradation levels of image data, the MCU 10 sends first control data indicating ON or OFF of 51.6% energy, sends second control data indicating ON or OFF of 25.8% energy, sends third control data indicating ON or OFF of 12.9% energy, sends fourth control data indicating ON or OFF of 6.5% energy, and finally sends fifth control data indicating ON or OFF of 3.2% energy for each heating element.

When printing an image of gradation level 4, 38.7% energy corresponding to energy level 12 needs to be applied to the heating element. In this case, the MCU 10 sends the first control data (OFF), the second control data (ON), the third control data (ON), the fourth control data (OFF), and the fifth control data (OFF) based on Table 7. As a result, a total of 38.7% energy (25.8%+12.9%) is applied to the heating element.

Thus, energy corresponding to gradation levels can be applied to the heating elements R by transferring a set of five of control data that correspond to different energy amounts. With the data transfer method described above, the thermal printer 100 can reduce the number of data transfer from the MCU 10 to the shift register 14 and can perform high-speed printing.

When printing an image with Table 2 with four gradation levels, energy corresponding to gradation levels of image data can be applied to the respective heating elements R1-R640 by setting an energy level table including 8 ($=2^3$) energy levels and transferring control data three times. When printing an image with Table 3 with 32 gradation levels, energy corresponding to gradation levels can be applied to the respective heating elements R by setting an energy level table including 64 ($=2^6$) energy levels and transferring control data six times.

Thus, when an image is to be printed based on a gradation table including $2^n$ gradation levels (n is an integer greater than or equal to 1), an energy level table including $2^m$ energy levels (m is an integer greater than n) is set based on the minimum energy difference between the gradation levels in the gradation table. The MCU 10 can apply energy corresponding to gradation levels to the heating elements R by transferring control data of different amounts of energy "m" times to the shift register 14.

Table 8 indicates an exemplary relationship between the number of times control data is transferred from the MCU 10 to the shift register 14 (transfer count) and the amounts of energy (energy values) represented by respective sets of control data.

TABLE 8

| | TRANSFER COUNT (NO. OF ENERGY LEVELS) | | | | | |
|---|---|---|---|---|---|---|
| | ONE ($2^1 = 2$ LEVELS) | TWO ($2^2 = 4$ LEVELS) | THREE ($2^3 = 8$ LEVELS) | FOUR ($2^4 = 16$ LEVELS) | FIVE ($2^5 = 32$ LEVELS) | SIX ($2^6 = 64$ LEVELS) |
| FIRST | 100.0% | 66.7% | 57.1% | 53.3% | 51.6% | 50.8% |
| SECOND | | 33.3% | 28.6% | 26.7% | 25.8% | 25.4% |
| THIRD | | | 14.3% | 13.3% | 12.9% | 12.7% |
| FOURTH | | | | 6.7% | 6.5% | 6.3% |
| FIFTH | | | | | 3.2% | 3.2% |
| SIXTH | | | | | | 1.6% |

An energy value $E_1$ represented by first control data transferred at the first time is obtained by formula (2) below.

$$E_1 = \frac{1}{2 - 2^{1-m}} \times 100 \tag{2}$$

Also, an energy value represented by control data transferred at the second or subsequent time is set to one half (½) of the energy value represented by control data transferred at the previous time. Thus, energy corresponding to gradation levels in a gradation table can be applied to the heating elements R by setting the amount of energy applied by each set of control data and transferring the control data for each of the heating elements R.

When energy is applied to a large number of heating elements at the same time, the power consumption may increase. Therefore, the MCU 10 transfers control data separately for each of the printing blocks: heating elements R1-R160 (first block), heating elements R161-R320 (second block), heating elements R321-R480 (third block), and heating elements R481-R640 (fourth block).

Figure 9A:
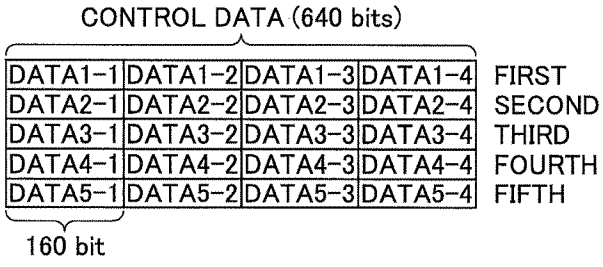
FIG. 9A is a drawing illustrating exemplary control data.

When transferring control data five times for each print line, the MCU 10 generates five sets of 640-bit control data (DATA 1 through DATA 5) for the heating elements R as illustrated in FIG. 9A. Then, the MCU 10 divides each set of the Nth control data into four sets of 160-bit control data (DATA N-1 through DATA N-4) corresponding to the printing blocks.

Figure 9B:
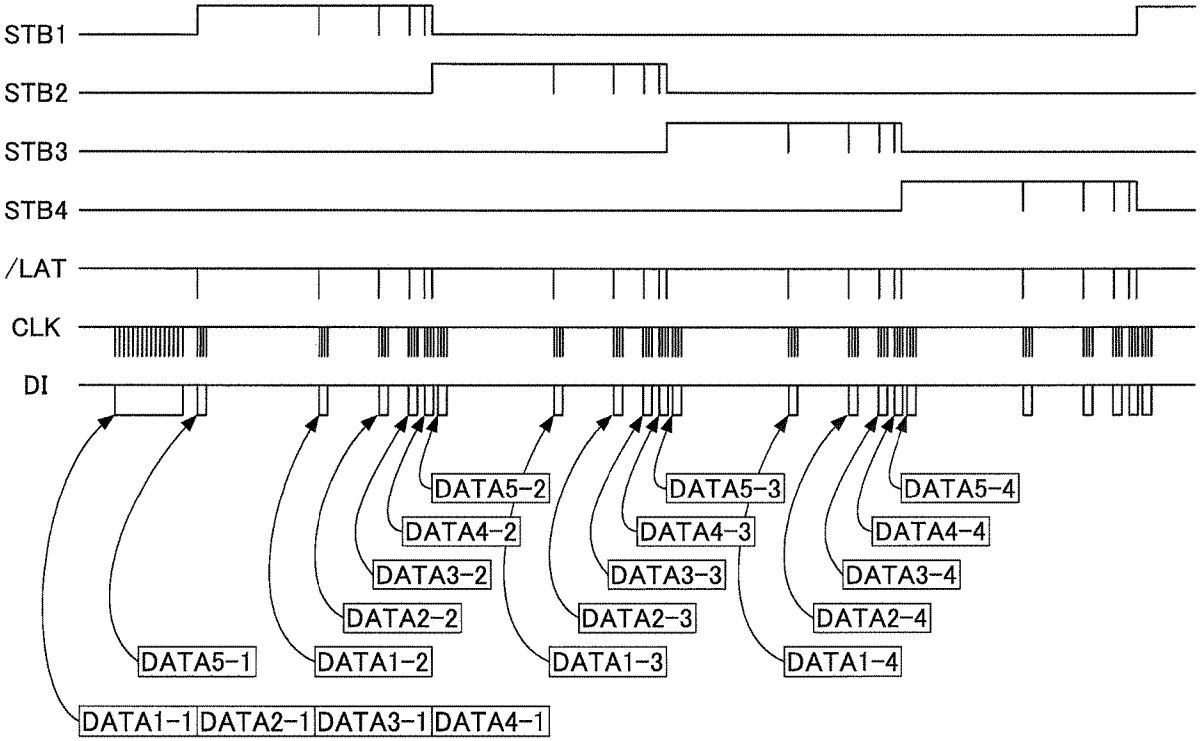
FIG. 9B is a timing chart illustrating a method of transferring control data.

As illustrated in FIG. 9B, the MCU 10 transfers first control data through fifth control data to the shift register 14 in sequence for each printing block. In FIG. 9B, the MCU 10 transfers control data DATA 1-1 through control data DATA 5-1 for the first block consecutively. Next, the MCU 10 transfers control data DATA 1-2 through control data DATA 5-2 for the second block consecutively. Similarly, the MCU 10 transfers control data DATA 1-3 through control data DATA 5-3 for the third block consecutively, and then transfers control data DATA 1-4 through control data DATA 5-4 for the fourth block consecutively. The control data transferred to the shift register 14 is transferred to the latch register 16, and then sent to the ICs corresponding to the heating elements R.

The MCU 10 also sends STB1 through STB4 in sequence to the ICs at the timings when power is supplied to the respective printing blocks. As a result, power is supplied to each printing block. The amount of energy to be applied to each heating element is controlled by power-supply period for which power is supplied to each heating element. The power-supply period is controlled by an input period for which STB signal is on. STB1 through STB4 are transferred for one printing block in succession by changing the input period based on the control data such that the energy amount set for each data transfer in Table 7 is applied to the corresponding heating elements. Thus, by transferring control data separately for each printing block and applying energy to heating elements, the number of heating elements to which power is supplied at the same time can be reduced to a maximum of 160, and the power consumption can be reduced.

Also, by transferring plural control data to each printing block consecutively, a power-supply interval (a time period between an end of a previous power supply and a start of next power supply) of the heating elements in the printing block can be made constant, and variation in print density due to variation in the power-supply interval can be reduced.

<Energy Amount Correction>

Next, a method of correcting the amount of energy applied to the heating elements R is described.

Even when the same amount of energy is applied to heating elements, the density of a printed image may vary depending on the type of recording medium used. This is because the amount of energy necessary to produce color varies depending on recording media. In the present embodiment, maximum values of energy applied to the heating elements R at the maximum gradation level are set for different types of recording media. By setting maximum energy values for different types of recording media, images with constant quality can be printed regardless of the types of recording media.

Table 9 is an example of an energy table stored in the RAM 11 where maximum energy values $E_0(P)$ are set for respective types of paper P. For example, for paper 1, the energy $E_0$ applied to the heating elements R at the maximum gradation level is 23.7 mJ/mm$^2$. The MCU 10 obtains, from the RAM 11, the maximum energy value $E_0(P)$ corresponding to the type of paper P to be used. The type of paper P may be determined based on, for example, a parameter preset in the thermal printer 100, or a parameter received by the thermal printer 100 together with print data. Based on the obtained maximum energy value $E_0(P)$, the MCU 10 sends various signals to the shift register 14 to apply energy set in a gradation table to the heating elements R.

TABLE 9

| PAPER P | $E_0$ (P) [mJ/mm$^2$] |
|---|---|
| PAPER 1 | 23.7 |
| PAPER 2 | 28.9 |
| PAPER 3 | 22.9 |
| PAPER 4 | 32.4 |
| PAPER 5 | 31.4 |

As described above, energy is applied separately to each of the printing blocks. Still however, when power is supplied to a large number of heating elements at the same time, a voltage drop may occur.

Figure 10:
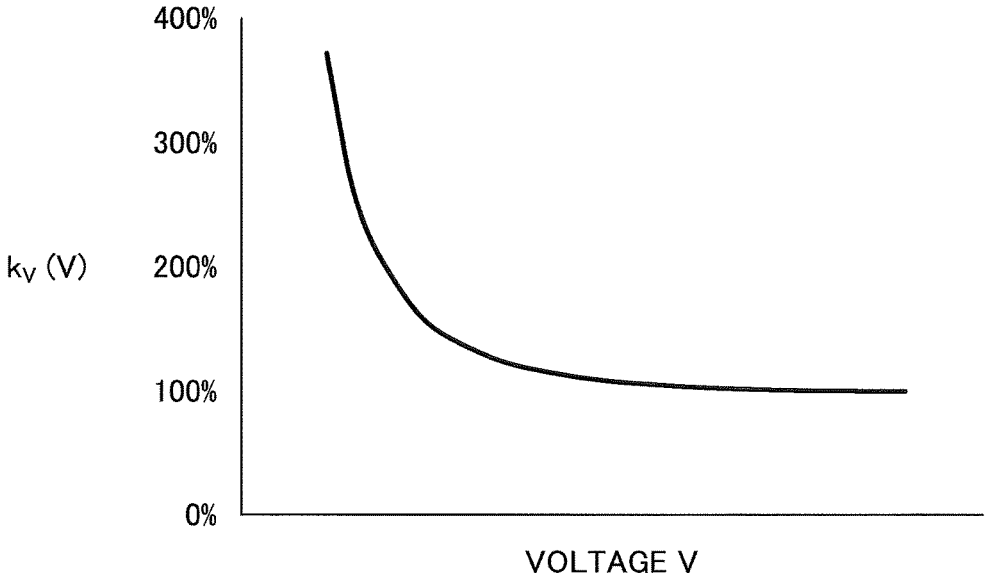
FIG. 10 is a graph illustrating a relationship between a supply voltage and a voltage correction value.

Therefore, one or more voltage correction values $k_v$ (V) for correcting the amount of energy applied to the heating elements R are set and stored in the RAM 11. The voltage correction values $k_v$ (V) are set based on a voltage V applied by the power supply 17 to the heating elements R. FIG. 10 is a graph illustrating a relationship between the voltage V and the voltage correction value $k_v$ (V). The MCU 10 obtains a voltage correction value $k_v$ (V) corresponding to the voltage V applied by the power supply 17 from the RAM 11 to correct the amount of energy to be applied to the heating elements R.

As described above, the MCU 10 supplies power to heating elements by transferring control data multiple times for each print line. The number of heating elements to which power is supplied may vary each time control data is transferred, and a voltage drop may occur when power is supplied to a large number of heating elements. Therefore, the timing to correct the amount of energy based on the voltage correction value $k_v$ (V) needs to be changed depending on the voltage of power supply 17. Because the amount of energy hardly varies in a high-voltage range, the amount of 100% energy is corrected for each print line when the thermal printer 100 is used with a high-voltage system. In contrast, when the thermal printer 100 is used with a low-voltage system such as a battery, the amount of energy varies greatly depending on the voltage, and the amount of energy needs to be corrected based on the number of heating elements to which power is supplied. Accordingly, in this case, the amount of energy is corrected each time power is supplied to the heating elements.

Also, even when the same amount of energy is applied to a heating element, the temperature of the heating element after application of energy may vary due to an influence of the temperature of the thermal head where the heating element is provided. Accordingly, even when image data with the same density is used, images with different density levels may be printed.

Figure 11:
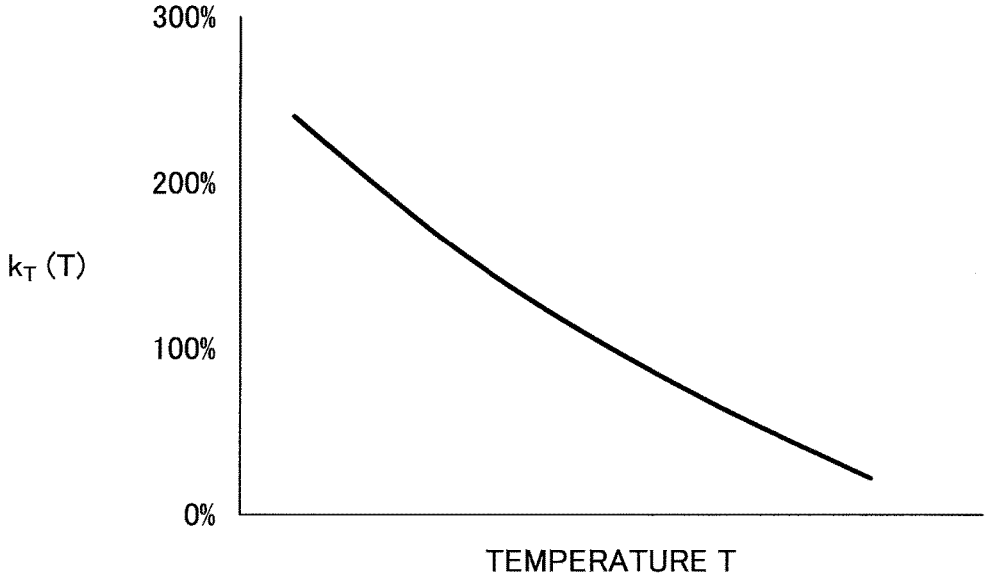
FIG. 11 is a graph illustrating a relationship between a temperature and a temperature correction value.

Therefore, one or more temperature correction values $k_T$ (T) for correcting the energy amount applied to the heating elements R may be set and stored in the RAM 11. The temperature correction values $k_T$ (T) are set based on a temperature T of the thermal head measured by the thermistor 12. FIG. 11 is a graph illustrating a relationship between the temperature T and $k_T$ (T). The temperature correction value $k_T$ (T) is set at a small value in a high-temperature range and increases as the temperature T decreases. The MCU 10 obtains a temperature correction value $k_T$ (T) corresponding to the measured temperature T from the RAM 11 to correct the amount of 100% energy to be applied to the heating elements R. Although the temperature of the heating elements R increases each time power is supplied, because the temperature of the heating elements R does not sharply increase, correction of the energy amount based on the temperature correction value $k_T$ (T) may be performed at any given timing, e.g., at 1 ms intervals.

Also, even when the same amount of energy is applied to a heating element, the temperature of the heating element after application of energy may vary because the degree to which the heating element radiates heat and cools varies depending on a period of time from an end of power supply for the previous print line to a start of power supply for the next print line (radiation time t). Accordingly, even when image data with the same density is used, images with different density levels may be printed.

Figure 12:
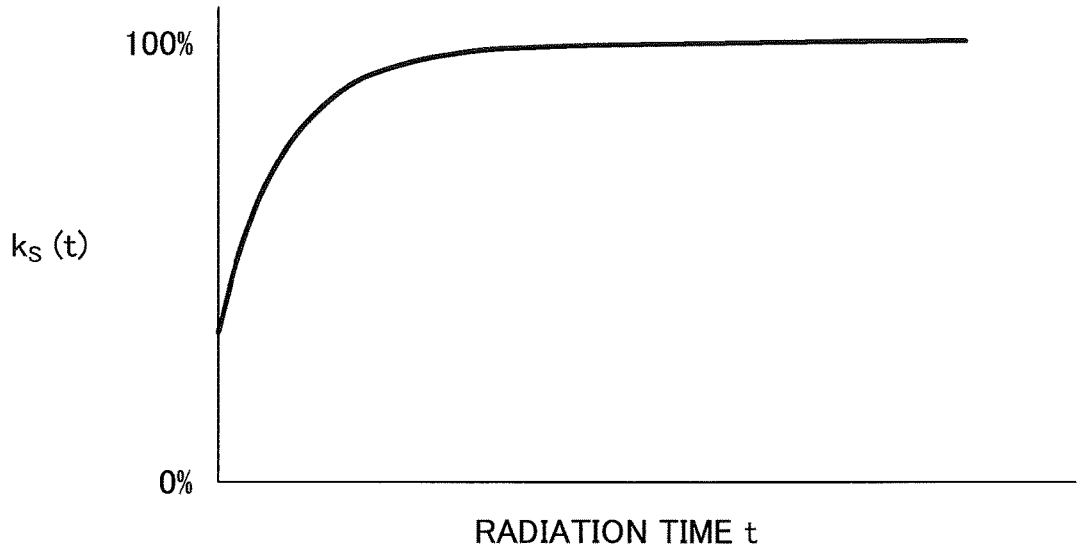
FIG. 12 is a graph illustrating a relationship between a radiation time and a speed correction value.

Therefore, one or more rate correction values $k_s$ (t) for correcting the amounts of energy applied to the heating elements R may be set and stored in the RAM 11. The rate correction values $k_s$ (t) are set based on the radiation time t of the heating elements R. FIG. 12 is a graph illustrating a relationship between the radiation time t and the rate correction value $k_s$ (t). The rate correction value $k_s$ (t) becomes smaller as the radiation time t decreases. The MCU 10 obtains a rate correction value $k_s$ (t) corresponding to the radiation time t from the RAM 11 for each print line, and corrects the amount of 100% energy to be applied to the heating elements R.

Further, even when the same amount of energy is applied to a heating element, the temperature of the heating element after application of energy may vary depending on whether power is supplied at the previous print line and/or whether power is supplied to an adjacent heating element. Accordingly, even when image data with the same density is used, images with different density levels may be printed.

Figure 13:
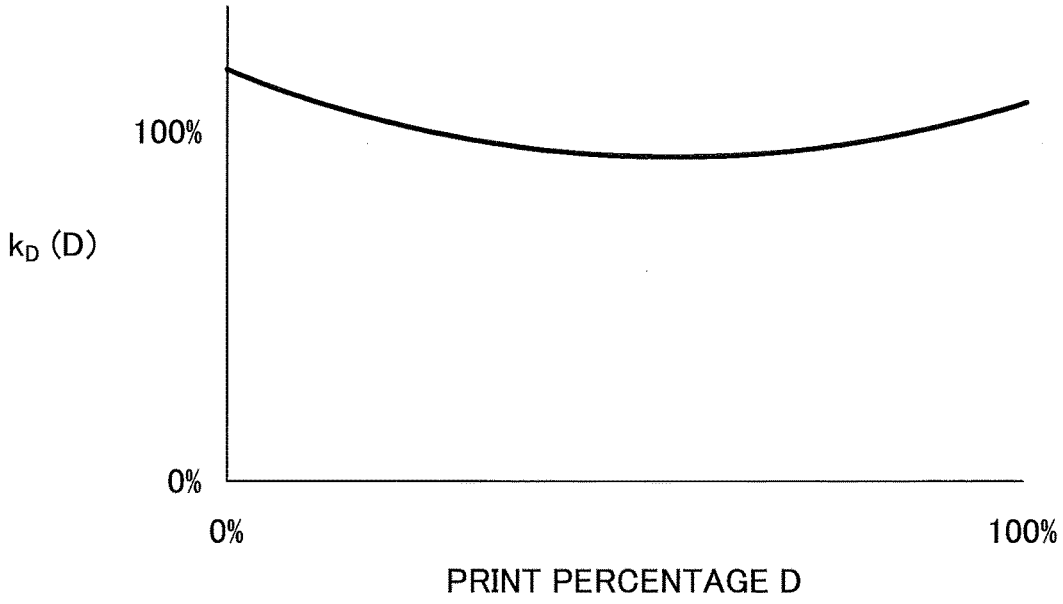
FIG. 13 is a graph illustrating a relationship between a print percentage and a print percentage correction value.

Therefore, one or more print percentage correction values $k_D$ (D) to correct the amount of energy applied to the heating elements R may be set and stored in the RAM 11 in association with print percentages D. The print percentage correction values $k_D$ (D) are determined based on a print percentage D. FIG. 13 is a graph illustrating a relationship between the print percentage D and the print percentage correction value $k_D$ (D). The MCU 10 obtains a print percentage correction value $k_D$ (D) corresponding to a print percentage D from the RAM 11, and corrects the amount of energy to be applied to the heating elements R.

Figure 14:
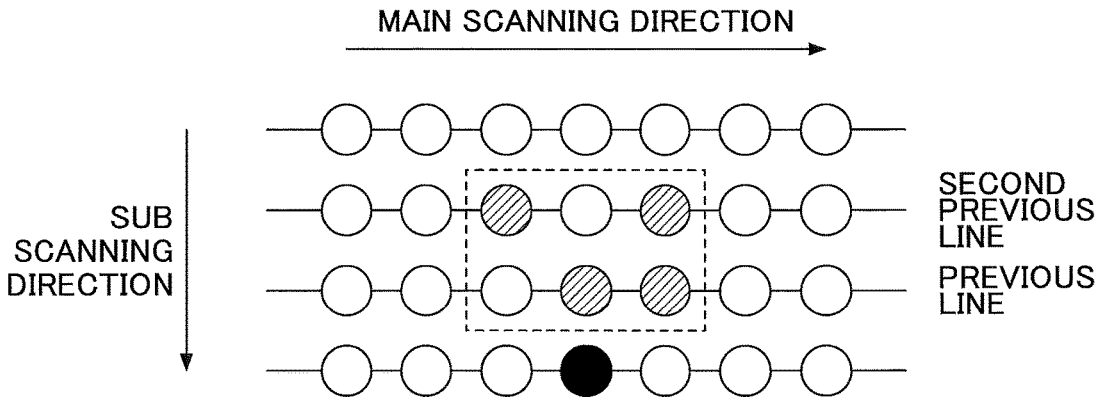
FIG. 14 is a drawing illustrating an exemplary method of calculating a print percentage.

For example, as illustrated in FIG. 14, the print percentage D is calculated based on six dots that are surrounded by a broken line. The six dots are in two previous lines that immediately precede, in the sub scanning direction, a line where a print dot indicated by a black circle exists. The print dot corresponds to one of the heating elements R1-R640. Two dots among the six dots are at the same position as the print dot in the main scanning direction, and four other dots are adjacent to these two dots. In FIG. 14, hatched circles indicate printed dots, and white circles indicate non-printed dots in which power is not supplied to the corresponding heating element. In this example, because four of the six dots surrounded by the broken line are printed, the print percentage D is $4/6\times100=66.7\%$.

The MCU 10 obtains a print percentage correction value $k_D$ (D) for each print dot from the RAM 11 based on the calculated print percentage D, and corrects the amount of energy to be applied to the heating element corresponding to the print dot based on the obtained print percentage correction value $k_D$ (D). The calculation of the print percentage D is not limited to the above described method.

As described above, in the present embodiment, the amount of energy applied to the heating elements R is corrected based on at least one of the voltage correction value $k_v$ (V), the temperature correction value $k_T$ (T), the rate correction value $k_s$ (t), and the print percentage correction value $k_D$ (D). By correcting the amount of energy applied to the heating elements R, images with constant quality can be printed.

Next, an exemplary image data process and an exemplary printing process performed by the thermal printer 100 are described.

<Image Data Process>

Figure 15:
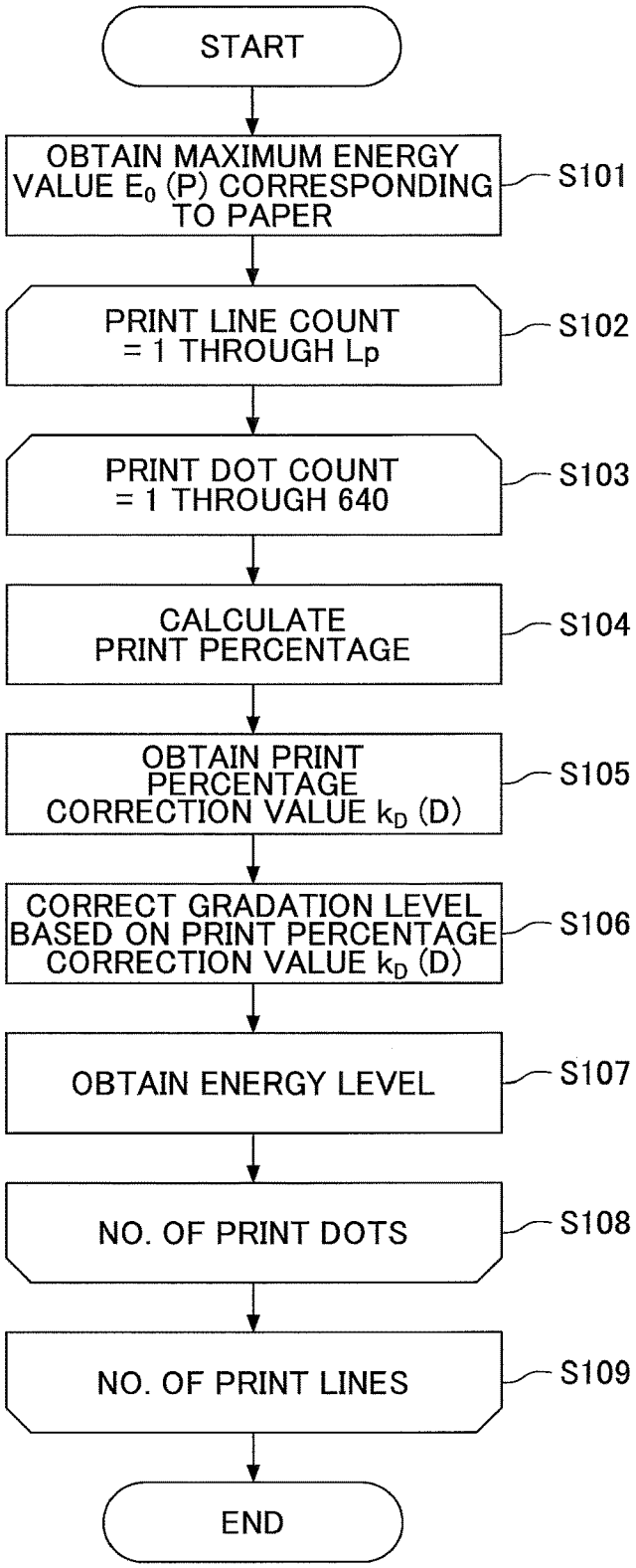
FIG. 15 is a flowchart illustrating an image data process according to a first embodiment.

FIG. 15 is a flowchart illustrating an image data process. When image data is input to the thermal printer 100, a process illustrated in FIG. 15 is performed.

At S101, the MCU 10 obtains a maximum energy value $E_0$ (P) corresponding to the type of paper used for printing from Table 9. Next, the MCU 10 repeats S102 through S109 for the number of print lines (print line count Lp) in the image data.

Also, the MCU 10 repeats S103 through S108 for the number of print dots (print dot count) in each print line. In the present embodiment, each print line includes 640 dots, and S103 through S108 are repeated 640 times for each print line because values are calculated for the respective dots. However, when such calculation is not necessary, repetition of those processes may be omitted.

At S104, the MCU 10 calculates, for the corresponding print dot or heating element, a print percentage D of two print lines immediately preceding the print dot. Next, at S105, the MCU 10 obtains a print percentage correction value $k_D$ (D) corresponding to the calculated print percentage D from the RAM 11.

At S5106, the MCU 10 corrects the gradation level of the print dot based on $k_D$ (D) obtained at S105. For example, when the gradation level of the print dot is 9 and $k_D$ (D) is 110%, the MCU 10 corrects the gradation level of the print dot to 10 (≈9×1.1).

At S107, the MCU 10 obtains an energy level corresponding to the gradation level corrected at S106 from the gradation-energy table (Table 6). For example, when the corrected gradation level is 10, the MCU 10 obtains an energy level 18.

In the process described above, the MCU 10 repeats S104 through S107 for the number of dots in each print line and repeats S103 through S108 for the number of print lines to obtain energy levels for all print dots in image data to be printed.

<Printing Process>

Figure 16:
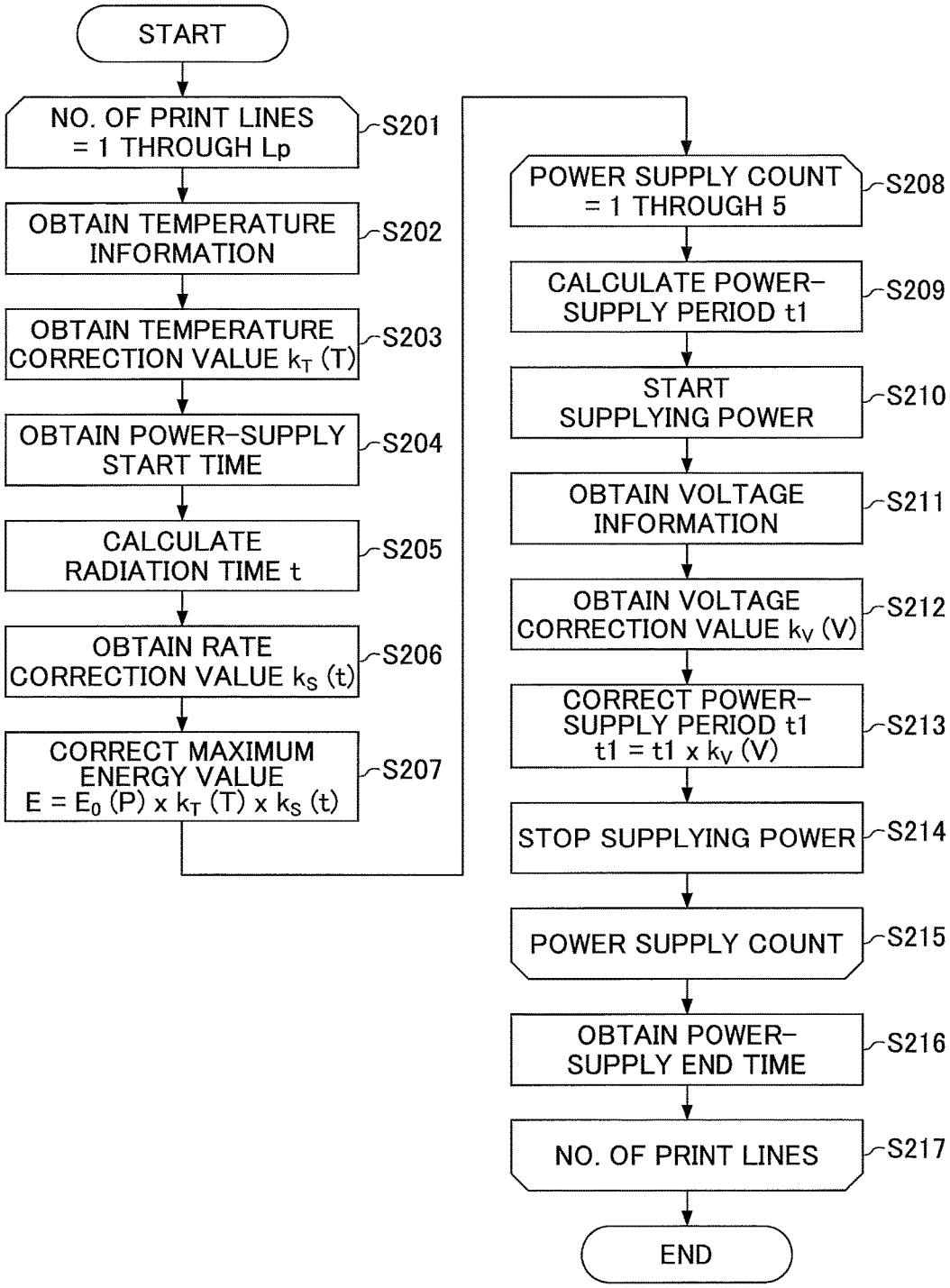
FIG. 16 is a flowchart illustrating a printing process.

FIG. 16 is a flowchart illustrating an exemplary printing process. When image data is input to the thermal printer 100, the MCU 10 performs the process of FIG. 15, and then performs a printing process illustrated by FIG. 16.

In the process of FIG. 16, the MCU 10 repeats S201 through S217 for the number of print lines (Lp) in the image data.

At S202, the MCU 10 obtains a temperature T of the thermal head from the thermistor 12. Next, at S203, the MCU 10 obtains a temperature correction value $k_T$ (T) corresponding to the obtained temperature T from the RAM 11.

At S204, the MCU 10 obtains a power-supply start time. At S205, the MCU 10 calculates a radiation time t from a power-supply end time of a previous print line to the power-supply start time obtained at S204. At S206, the MCU 10 obtains a rate correction value $k_s$ (t) corresponding to the calculated radiation time t from the RAM 11.

At S207, the MCU 10 corrects the maximum energy value $E_0$ (P) obtained at S101 based on $k_T$ (T) and $k_s$ (t) according to formula (3) to obtain a corrected maximum energy value E to be applied to the heating elements R, and converts the corrected maximum energy value E into a power-supply period.

$$E=E_0(P)\times k_T(T)\times k_s(t) \tag{3}$$

Next, the MCU 10 repeats S208 through S215 for the number of times power is supplied to the heating elements R (power supply count). In FIG. 16, the power supply count per print line is five.

At S209, the MCU 10 calculates a power-supply period t1 corresponding to the amount of energy to be supplied to heating elements each time. For example, when the power supply count is five as indicated by Table 7, the MCU 10 calculates t1 such that an amount of energy corresponding to 51.6% of the corrected maximum energy value E obtained at S207 is applied to heating elements at the first time. For the second and subsequent times, the MCU 10 calculates the power-supply period t1 such that amounts of energy corresponding to 25.8%, 12.9%, 6.5%, and 3.2% of the corrected maximum energy value E are applied sequentially to heating elements. The power-supply period is controlled by changing the length of time for which the STB signal is turned on.

At S210, the MCU 10 starts supplying power to the heating elements. At S211, the MCU 10 obtains a voltage V being supplied from the power supply 17 to the heating elements.

At S212, the MCU 10 obtains a voltage correction value $k_v$ (V) corresponding to the voltage V from the RAM 11. At S213, the MCU 10 corrects the power-supply period t1 calculated at S209 based on the voltage correction value $k_v$ (V) according to formula (4) below.

$$t1=t1\times k_v(V) \tag{4}$$

At S214, the MCU 10 stops supplying power to the heating elements when the corrected power-supply period t1 passes after start of the power supply. The power-supply period t1 corresponds to a length of time for which the STB signal is turned on. Thus, the MCU 10 controls t1 for each time so that the amounts of energy indicated by energy levels corresponding to gradation levels of image data are applied to the corresponding heating elements R1-R640.

When the power is supplied to the heating elements for the predetermined number of times and printing of one print line is completed, the MCU 10 obtains a power-supply end time at S216. The MCU 10 calculates a radiation time t for the next print line at S205 based on the obtained power-supply end time.

S201 through S217 are repeated for the print line count Lp in the image data, and printing of the image data on a recording medium is completed.

Thus, the thermal printer 100 performs the image data process and then performs the printing process described above to print an image on a recording medium.

As described above, in the present embodiment, the amount of energy to be applied to each heating element is set based on a dot area ratio to improve the gradation reproducibility of a printed image. Also in the present embodiment, the number of times control data is transferred is reduced so that a high-resolution image can be printed at a high speed. Further in the present embodiment, the amount of energy to be applied to heating elements is corrected based on at least one of the voltage V applied by the power supply 17 to the heating elements, the temperature T of the thermal head, the radiation time t, and the print percentage D so that images with constant quality can be printed regardless of changes in various conditions.

Second Embodiment

Next, a second embodiment is described. In the second embodiment, descriptions of components that are the same as the components described in the first embodiment may be omitted.

Assuming that a 16-gradation-level image is printed with Table 7, when a dot with gradation level 8 and a dot with gradation level 7 are consecutively arranged in the sub-scanning direction, printing is performed with energy level 16 and then with energy level 15.

Figure 17A:
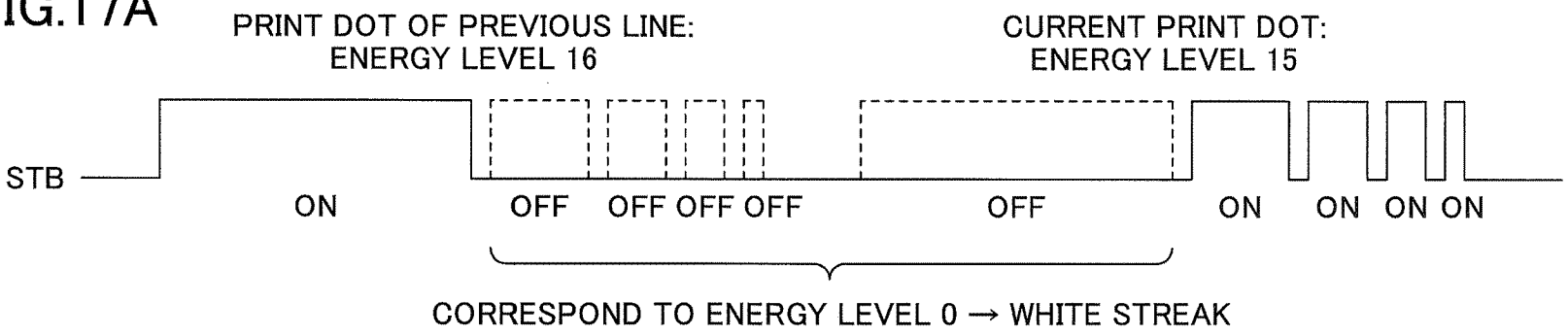
FIGS. 17A and 17B are drawings used to describe a white streak and a black streak.

As illustrated in FIG. 17A, when printing a dot with energy level 16, the second control data through the fifth control data are "OFF". Accordingly, no voltage is applied to the heating element and no image is printed during a period that the second control data through the fifth control data are output. When printing a dot with energy level 15 following the printing with energy level 16, the first control data is "OFF". Accordingly, no voltage is applied to the heating element during a period that the first control data is output.

Thus, during a period that the second control data in the printing with energy level 16 through the first control data in the printing with energy level 15 are output, the amount of energy becomes equivalent to energy level 0 and a non-printed area is formed. Accordingly, in the portion of the image where a dot with gradation level 8 and a dot with gradation level 7 are consecutively arranged, the non-printed area may appear as a white streak in the image.

Further, when a dot with gradation level 7 and a dot with gradation level 8 are consecutively arranged in the sub-scanning direction, the dots are printed with energy level 15 and then with energy level 16.

Figure 17B:
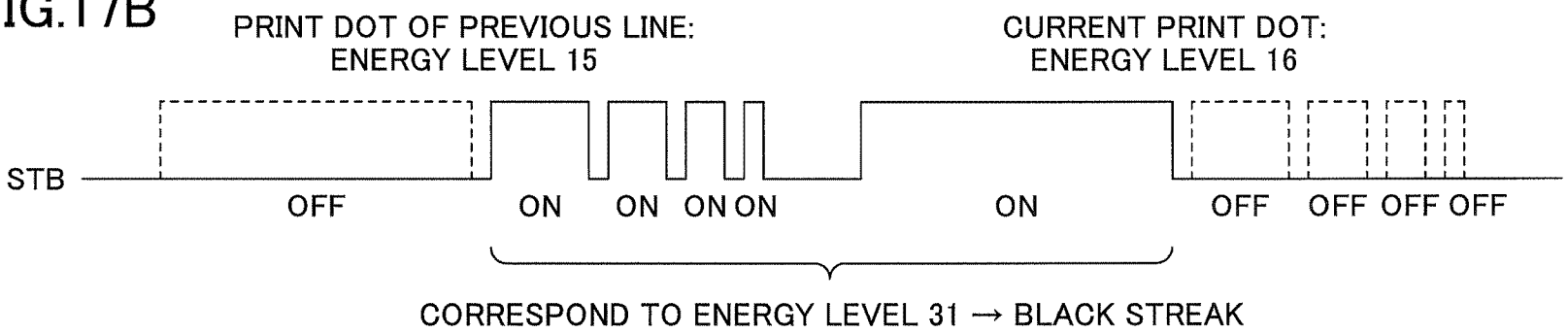

As illustrated in FIG. 17B, when printing a dot with energy level 15, the second control data through the fifth control data are "ON". Accordingly, a voltage is applied to the heating element and an image is printed during a period that the second control data through the fifth control data are output. Also, in the printing with energy level 16 following the printing with energy level 15, the first control data is "ON". Accordingly, a voltage is applied to the heating element and an image is printed during a period that the first control data is output.

Thus, during a period that the second control data in the printing with energy level 15 through the first control data in the printing with energy level 16 are output, the amount of energy becomes equivalent to energy level 31 (gradation level 15) and a printed area is formed. Accordingly, in the portion of the image where a dot with gradation level 7 and a dot with gradation level 8 are consecutively arranged, the printed area may appear as a black streak in the image.

In a gradation-energy table of the second embodiment (Table 10), multiple energy levels are set for each gradation level of the "current" print dot in the current print line in association with gradation levels of the "previous" print dot located in the previous print line in the same position as the current print dot in the main scanning direction so that printing with energy level 15 and printing with energy level 16 are not performed consecutively.

In Table 10, for gradation level 7 of the current print dot, energy level 15 is set in association with the previous print dot with gradation levels 0-7 and 9-15, and energy level 17 is set in association with the previous print dot with gradation level 8. For the current print dot with gradation level 8, energy level 16 is set in association with the previous print dot with gradation levels 0-6 and 8-15, and energy level 14 is set in association with the previous print dot with gradation level 7. For the current print dot with gradation levels 0-6 and 9-15, the same energy levels as those in Table 6 are set regardless of the gradation levels of the previous print dot.

TABLE 10

| GRADATION LEVEL OF PRINT DOT | GRADATION LEVEL IN PREVIOUS LINE: 0-6 AND 9-15 | GRADATION LEVEL IN PREVIOUS LINE: 7 | GRADATION LEVEL IN PREVIOUS LINE: 8 |
|---|---|---|---|
| 0 | 0 | 0 | 0 |
| 1 | 8 | 8 | 8 |
| 2 | 10 | 10 | 10 |
| 3 | 11 | 11 | 11 |
| 4 | 12 | 12 | 12 |
| 5 | 13 | 13 | 13 |
| 6 | 14 | 14 | 14 |
| 7 | 15 | 15 | 17 |
| 8 | 16 | 14 | 16 |
| 9 | 17 | 17 | 17 |
| 10 | 18 | 18 | 18 |
| 11 | 20 | 20 | 20 |
| 12 | 21 | 21 | 21 |
| 13 | 23 | 23 | 23 |
| 14 | 26 | 26 | 26 |
| 15 | 31 | 31 | 31 |

With Table 10, when dots with gradation levels 8, 8, 7, and 7 are arranged consecutively in the sub scanning direction, the energy levels of the dots become 16, 16, 17, and 15. Accordingly, printing of a dot with energy level 15 immediately after printing a preceding dot in the sub scanning direction with energy level 16 is prevented, and a white streak can be prevented.

Also with Table 10, when dots with gradation levels 7, 7, 8, and 8 are arranged consecutively in the sub scanning direction, the energy levels of the dots become 15, 15, 14, and 16. Accordingly, printing a dot with energy level 16 immediately after printing a preceding dot in the sub scanning direction with energy level 15, and a formation of a black streak is prevented.

Thus, white and black streaks is prevented by setting multiple energy levels for the current print dot of certain gradation level in association with gradation levels of the preceding print dots.

A gradation-energy table different from the described gradation-energy table may be used depending on the number of gradation levels of an image to be printed and data transfer conditions in a control table.

Third Embodiment

Next, a third embodiment is described.

Figure 18A:
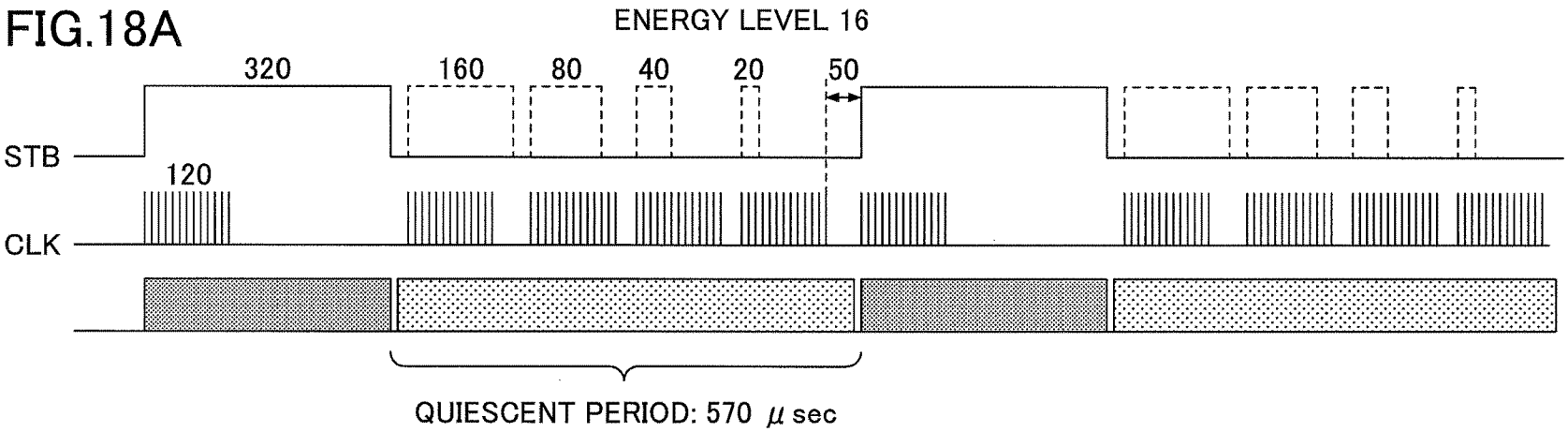
FIGS. 18A and 18B are drawings used to describe a case where print densities are reversed.
Figure 18B:
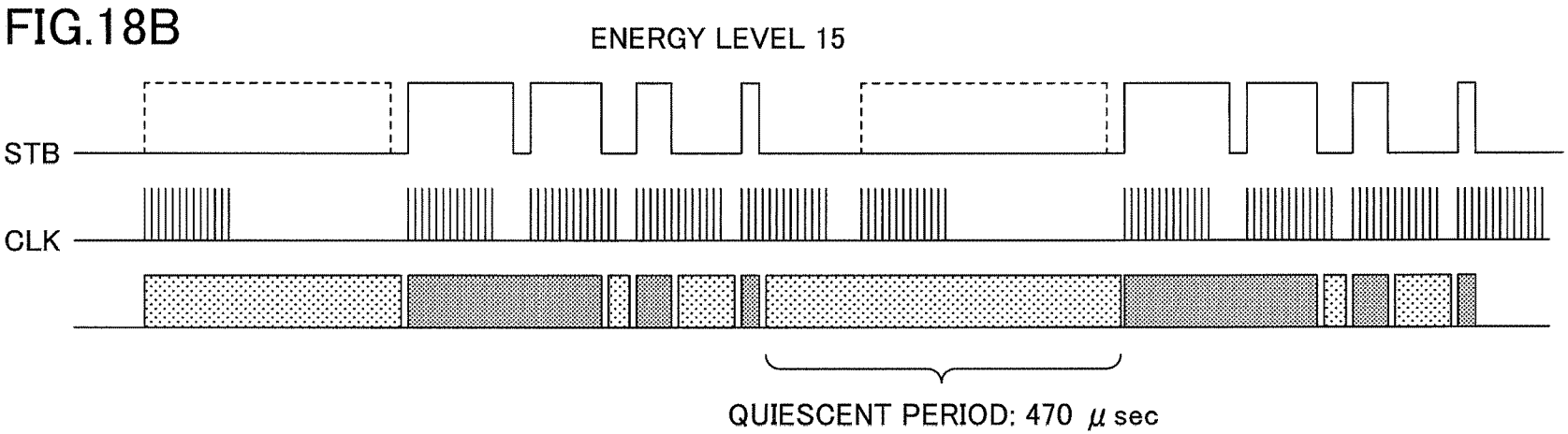

FIG. 18A illustrates the data transfer timing and the power-supply timing in a case where dots with gradation level 8 (energy level 16) appear consecutively in printing a 16-gradation-level image using Table 7. FIG. 18B illustrates the data transfer timing and the power-supply timing in a case where dots with gradation level 7 (energy level 15) appear consecutively. In FIGS. 18A and 18B, it is assumed that the data transfer time is 120 μs, the printing interval is 890 μs (printing speed: about 140 mm/sec), and the power supply time for 100% energy is 640 μs. Numerals in FIG. 18A indicate time (μs).

In consecutive printing in FIG. 18A, a quiescent period of 570 μs exists. In case of FIG. 18B, a quiescent period of 470 μs exists.

The heat radiation amount of a heating element varies depending on the length of the quiescent period between the end of power supply for the previous print line and the start of power supply for the next print line. Accordingly, even when the same amount of energy is applied to a heating element, the temperature of the heating element after the application of energy varies depending on the length of the quiescent period.

As illustrated in FIGS. 18A and 18B, the quiescent period in the consecutive printing with energy level 15 (470 μs) is shorter than the quiescent period in the continuous printing with energy level 16 (570 μs). In the consecutive printing with energy level 15, the temperature of heating elements tends to more easily increase due to residual heat remaining after printing the previous print line compared with the consecutive printing with energy level 16. Therefore, the print density in the consecutive printing with energy level 15 may become higher than the print density in the consecutive printing with energy level 16 in certain case. Also, the influence of the residual heat of heating elements remaining after printing the previous line increases as the printing speed increases.

Figure 19A:
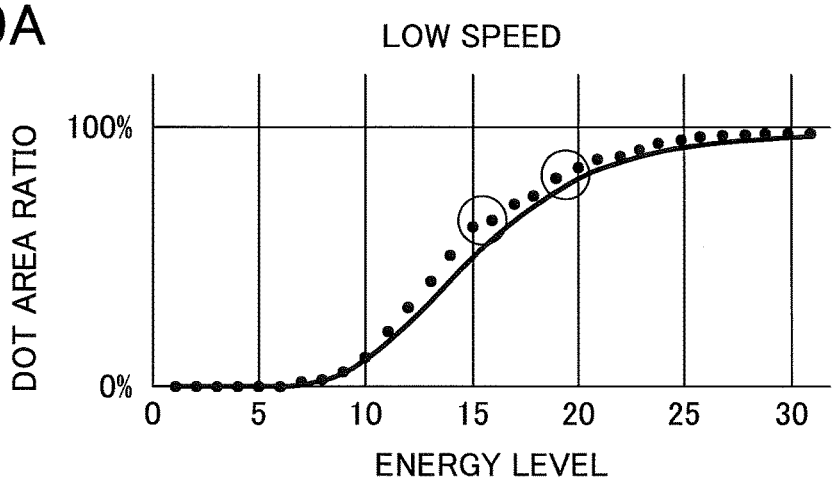
FIGS. 19A through 19C are graphs illustrating relationships between an energy level and a dot area ratio observed with different printing speeds.
Figure 19B:
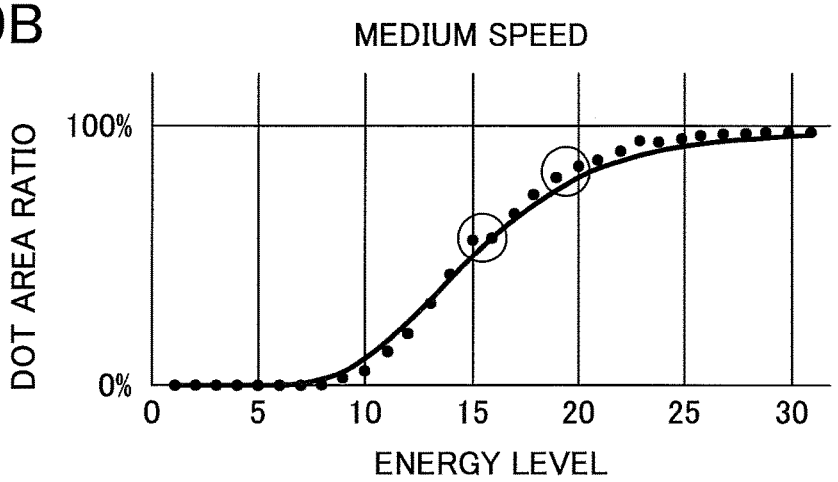
Figure 19C:
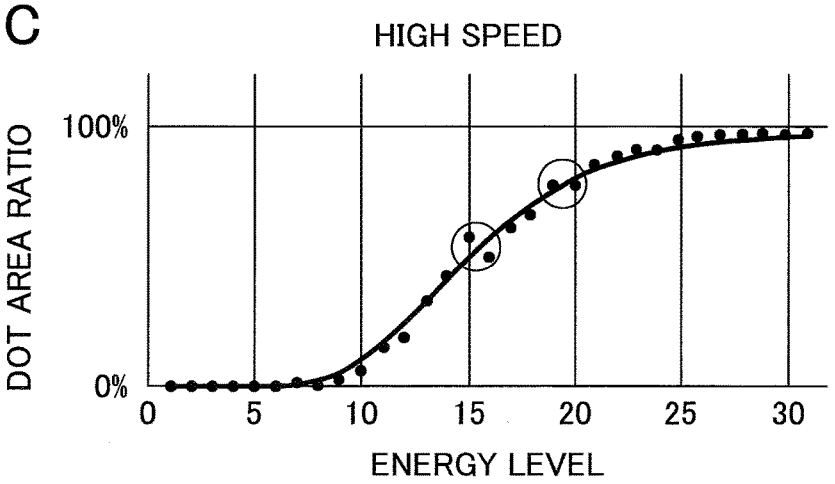

FIGS. 19A through 19C are graphs illustrating relationships between an energy level and a dot area ratio of an image observed with different printing speeds. FIG. 19A illustrates a case where the printing speed is low, FIG. 19B illustrates a case where the printing speed is medium, and FIG. 19C illustrates a case where the printing speed is high.

As illustrated in FIG. 19A, when the printing speed is low, the dot area ratio gradually increases as the energy level increases As illustrated in FIG. 19B, when the printing speed is medium, the dot area ratio at energy level 15 is greater than the dot area ratio at energy level 16. That is, the dot area ratios formed at energy levels 15 and 16 are reversed.

As illustrated in FIG. 19C, when the printing speed is high, the dot area ratio at energy level 15 is greater than the dot area ratio at energy level 16, and the dot area ratio at energy level 19 is greater than the dot area ratio at energy level 20. Thus, when the printing speed is high, the dot area ratios formed at energy levels 15 and 16 are reversed, and the dot area ratios formed at energy levels 19 and 20 are reversed.

As described above, due to the influence of residual heat remaining after printing the previous print line, the dot area ratio at a lower energy level may become greater than that at a higher energy level.

In the present embodiment, energy level 16 is omitted from a gradation-energy table of Table 11 among one of energy levels 15 and 16 at which print densities may be reversed depending on printing speeds. Similarly, energy level 19 is omitted from Table 11 among energy levels 19 and 20.

TABLE 11

| GRADATION LEVEL | ENERGY LEVEL |
|---|---|
| 0 | 0 |
| 1 | 7 |
| 2 | 9 |
| 3 | 10 |
| 4 | 11 |
| 5 | 12 |

TABLE 11-continued

| GRADATION LEVEL | ENERGY LEVEL |
|---|---|
| 6 | 13 |
| 7 | 14 |
| 8 | 15 |
| 9 | 17 |
| 10 | 18 |
| 11 | 20 |
| 12 | 21 |
| 13 | 23 |
| 14 | 26 |
| 15 | 31 |

Thus, in the present embodiment, energy levels are set such that the print density gradually changes in accordance with changes in the gradation level regardless of the printing speed. Therefore, an image with high gradation reproducibility can be printed without causing reversal of print densities at any printing speed.

Energy levels different from those in the gradation-energy table of the present embodiment may also be used depending on, for example, the number of gradation levels of an image to be printed and data transfer conditions in a control table.

Fourth Embodiment

Next, a fourth embodiment is described.

In the fourth embodiment, when printing multiple images with different gradation scales in the same area, all of the images are printed with a target gradation scale of one of the images by converting the original gradation levels of other images in original gradation scales into target gradation levels in the target gradation scale of the one of the images. For example, when a first image with a 4-level gradation scale and a second image with a 16-level gradation scale are to be printed in the same area, the original gradation levels of the first image in the 4-level gradation scale (original gradation scale) are converted into target gradation levels in the 16-level gradation scale (target gradation scale), and the first image and the second image are printed using the 16-level gradation scale. The original gradation levels of the second image in the 16-level gradation scale (original gradation scale) may be converted into target gradation levels in the 4-level gradation scale (target gradation scale), to print the first and second images using the 4-level gradation scale. For example, gradation levels are converted using formula (5).

$$\text{TARGET GRADATION LEVEL} = \left(\begin{array}{c}\text{NO. OF GRADATION}\\ \text{LEVELS IN TARGET}\\ \text{GRADATION SCALE}\end{array} - 1\right) \times \begin{array}{c}\text{ORIGINAL}\\ \text{GRADATION}\\ \text{LEVEL}\end{array} + \frac{\left(\begin{array}{c}\text{NO. OF GRADATION LEVELS}\\ \text{IN ORIGINAL GRADATION SCALE}\end{array} - 2\right)}{\begin{array}{c}\text{NO. OF GRADATION LEVELS IN}\\ \text{ORIGINAL GRADATION SCALE}\end{array} - 1} \tag{5}$$

As exemplified by Table 12, when converting the original gradation levels of the first image into target gradation levels in the 16-level gradation scale, original gradation level 1 of the first image is converted into target gradation level 5 by using formula (5) "((16−1)×1+(4−2))/(4−1)=5.667" and truncating digits after the decimal point. Similarly, other original gradation levels of the first image are converted into target gradation levels in the 16-level gradation scale as illustrated in Table 12.

TABLE 12

| ORIGINAL GRADATION LEVEL (4-LEVEL GRADATION SCALE) | TARGET GRADATION LEVEL (16-LEVEL GRADATION SCALE) |
|---|---|
| 0 | 0 |
| 1 | 5 |
| 2 | 10 |
| 3 | 15 |

Also, as exemplified by Table 13, when converting the original gradation levels of the second image into target gradation levels in the 4-level gradation scale, original gradation level 1 of the second image is converted into target gradation level 1 by using formula (5) "((4−1)×1+(16−2))/(16−1)=1.133" and truncating digits after the decimal point. Similarly, other original gradation levels of the second image can be converted into target gradation levels in the 4-level gradation scale as illustrated in Table 13.

TABLE 13

| ORIGINAL GRADATION LEVEL (16-LEVEL GRADATION SCALE) | TARGET GRADATION LEVEL (4-LEVEL GRADATION SCALE) |
|---|---|
| 0 | 0 |
| 1 | 1 |
| 2 | 1 |
| 3 | 1 |
| 4 | 1 |
| 5 | 1 |
| 6 | 2 |
| 7 | 2 |
| 8 | 2 |
| 9 | 2 |
| 10 | 2 |
| 11 | 3 |
| 12 | 3 |
| 13 | 3 |
| 14 | 3 |
| 15 | 3 |

<Image Data Process>

Figure 20:
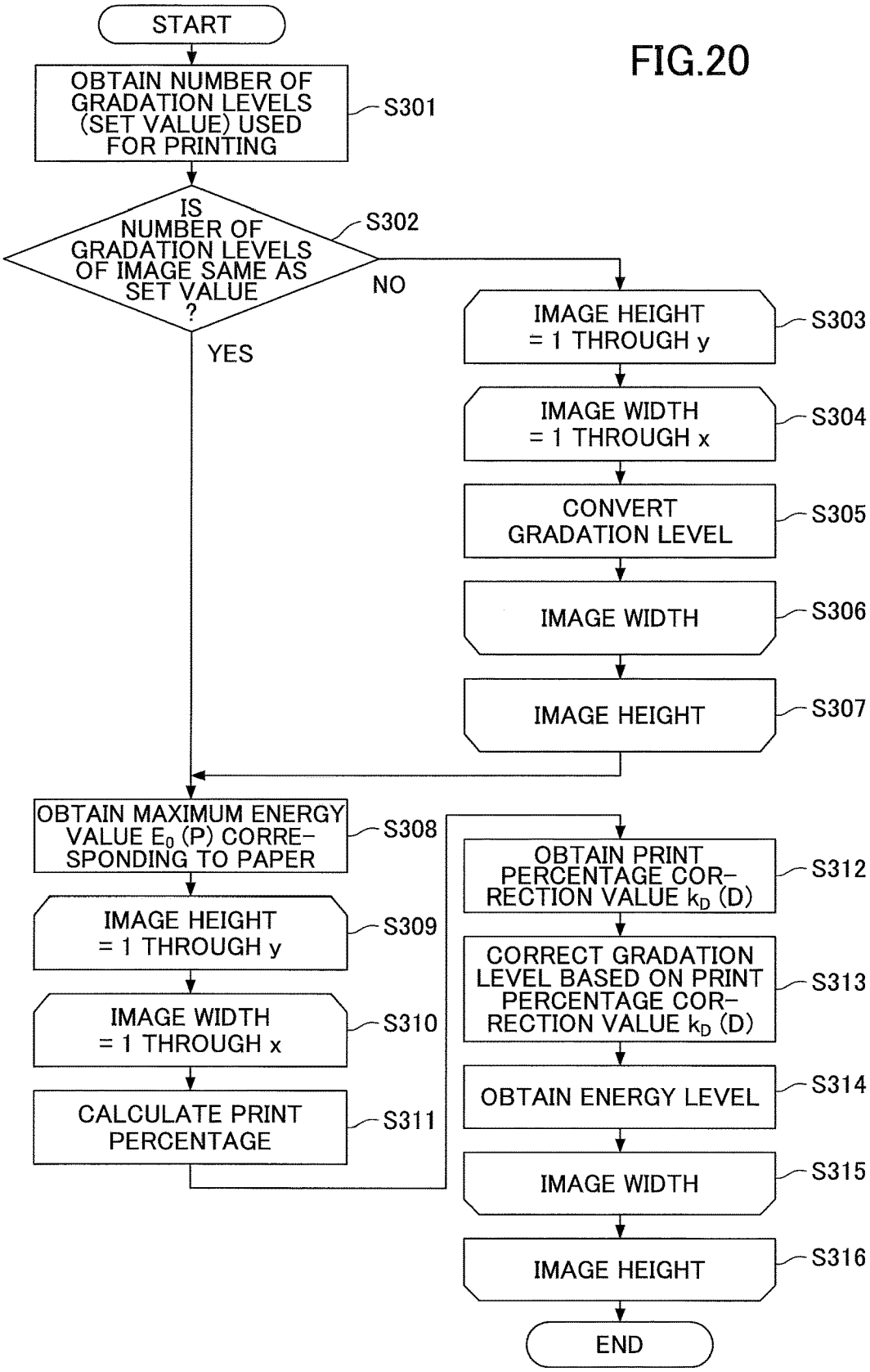
FIG. 20 is a flowchart illustrating an image data process according to a fourth embodiment.

FIG. 20 is a flowchart illustrating an image data process according to the fourth embodiment. When image data is input to the thermal printer 100, a process illustrated in FIG. 20 is performed.

At S301, the MCU 10 obtains the number of gradation levels (set value) used for printing. When the number of gradation levels of a print image is the same as the set value (S302: YES), the MCU 10 proceeds to S308.

When the number of gradation levels of the print image is different from the set value (S302: NO), the MCU 10 repeats S303 through S307 to convert the gradation levels of respective dots in each line of the image. When the height of the image is y and the width of the image is x, process of S303 through S307 are repeated y times, and process of S304 through S306 are repeated x times for each line of the image.

At S305, the MCU 10 obtains a target gradation level for each dot in the image using formula (5).

At S308, the MCU 10 obtains a maximum energy value $E_0$ (P) corresponding to the type of paper used for printing from Table 9. Next, the MCU 10 repeats S309 through S316 for the number of print lines in the image.

The MCU 10 repeats S310 through S315 for the number of print dots in each print line. At S311, the MCU 10 calculates a print percentage D of two print lines immediately preceding the print dot. Next, at S312, the MCU 10 obtains a print percentage correction value $k_D$ (D) corresponding to the calculated print percentage D from the RAM 11.

At S313, the MCU 10 corrects the gradation level of the print dot based on $k_D$ (D) obtained at S312. At S314, the MCU 10 obtains an energy level corresponding to the gradation level corrected at S313 from a gradation-energy table.

Multiple images with different gradation scales can be printed by performing the process described above before performing a printing process. For example, when a first image with a 4-level gradation scale and a second image with a 16-level gradation scale are to be printed, both of the first image and the second image is printed using the 16-level gradation scale by converting the original gradation levels of the first image into target gradation levels in the 16-level gradation scale. On the other hand, the original gradation levels of the second image may be converted into target gradation levels in the 4-level gradation scale, to print the first and second images with the 4-level gradation scale. This makes it possible to print the images at high speed.

Even when printing three or more images with different gradation scales, all of the images can be printed using a gradation scale of one of the images by converting the original gradation levels of other images into target gradation levels in the gradation scale of the one of the images.

Fifth Embodiment

Next, a fifth embodiment is described.

In the fifth embodiment, similar to the fourth embodiment, multiple images with different gradation scales can be printed in the same area, by converting the original energy levels of other images in original energy scales into target energy levels in the target energy scale of the one of the images.

For example, when a first image with a 4-level gradation scale and a second image with a 16-level gradation scale are to be printed, energy levels corresponding to the gradation levels of the first image and energy levels corresponding to the gradation levels of the second image are obtained. Then, the original energy levels of the first image in an 8-level energy scale (original energy scale) are converted into target energy levels in a 32-level energy scale (target energy scale) of the second image, and the first and the second images are printed with the 32-level energy scale. The original energy levels of the second image in the 32-level energy scale (original energy scale) may be converted into target energy levels in the 8-level energy scale (target energy scale) of the first image, and the first and second images are printed with the 8-level energy scale. For example, energy levels are converted using formula (6).

$$\text{TARGET ENERGY LEVEL} = \frac{\left(\begin{array}{c}\text{NO. OF ENERGY}\\ \text{LEVELS IN TARGET}\\ \text{ENERGY SCALE}\end{array} - 1\right) \times \begin{array}{c}\text{ORIGINAL}\\ \text{ENERGY}\\ \text{LEVEL}\end{array} + \left(\begin{array}{c}\text{NO. OF ENERGY LEVELS}\\ \text{IN ORIGINAL ENERGY SCALE}\end{array} - 2\right)}{\begin{array}{c}\text{NO. OF ENERGY LEVELS IN}\\ \text{ORIGINAL ENERGY SCALE}\end{array} - 1} \quad (6)$$

As exemplified by Table 14, when converting the original energy levels of the first image into target energy levels in the 32-level energy scale, original energy level 3 corresponding to gradation level 1 of the first image is converted into target energy level 14 by using formula (6) "((32−1)×3+(8−2))/(8−1)=14.143" and truncating digits after the decimal point. Similarly, other original energy levels of the first image can be converted into target energy levels in the 32-level energy scale as illustrated in Table 14 by using formula (6).

TABLE 14

| GRADATION LEVEL | ORIGINAL ENERGY LEVEL (8-LEVEL ENERGY SCALE) | TARGET ENERGY LEVEL (32-LEVEL ENERGY SCALE) |
|---|---|---|
| 0 | 0 | 0 |
| 1 | 3 | 14 |
| 2 | 4 | 19 |
| 3 | 7 | 32 |

Also, as exemplified by Table 15, when converting the original energy levels of the second image in the 32-level energy scale into target energy levels in the 8-level energy scale, original energy level 8 corresponding to gradation level 1 of the second image is converted into target energy level 2 by using formula (6) "((8−1)×8+(32−2))/(32−1)=2.774" and truncating digits after the decimal point. Similarly, other original energy levels of the second image can be converted into target energy levels in the 8-level energy scale as in Table 15 by using formula (6).

TABLE 15

| GRADATION LEVEL | ORIGINAL ENERGY LEVEL (32-LEVEL ENERGY SCALE) | TARGET ENERGY LEVEL (8-LEVEL ENERGY SCALE) |
|---|---|---|
| 0 | 0 | 0 |
| 1 | 8 | 2 |
| 2 | 10 | 3 |
| 3 | 11 | 3 |
| 4 | 12 | 3 |
| 5 | 13 | 3 |
| 6 | 14 | 4 |
| 7 | 15 | 4 |
| 8 | 16 | 4 |
| 9 | 17 | 4 |
| 10 | 18 | 5 |
| 11 | 20 | 5 |
| 12 | 21 | 5 |
| 13 | 23 | 6 |
| 14 | 26 | 6 |
| 15 | 31 | 7 |

When converting the original gradation levels of the second image in the 16-level gradation scale into target gradation levels in the 4-level gradation scale and obtaining energy levels corresponding to the target gradation levels as in the fourth embodiment, the second image is printed with four energy levels (0, 3, 4, 7). In contrast, when converting the original energy levels of the second image in the 32-level energy scale corresponding to the 16-level gradation scale into target energy levels in the 8-level energy scale as described above, the second image is printed with seven energy levels (0, 2, 3, 4, 5, 6, 7) as in Table 15. Thus, the present embodiment can improve the gradation reproducibility of the second image in a printed image.

<Image Data Process>

Figure 21:
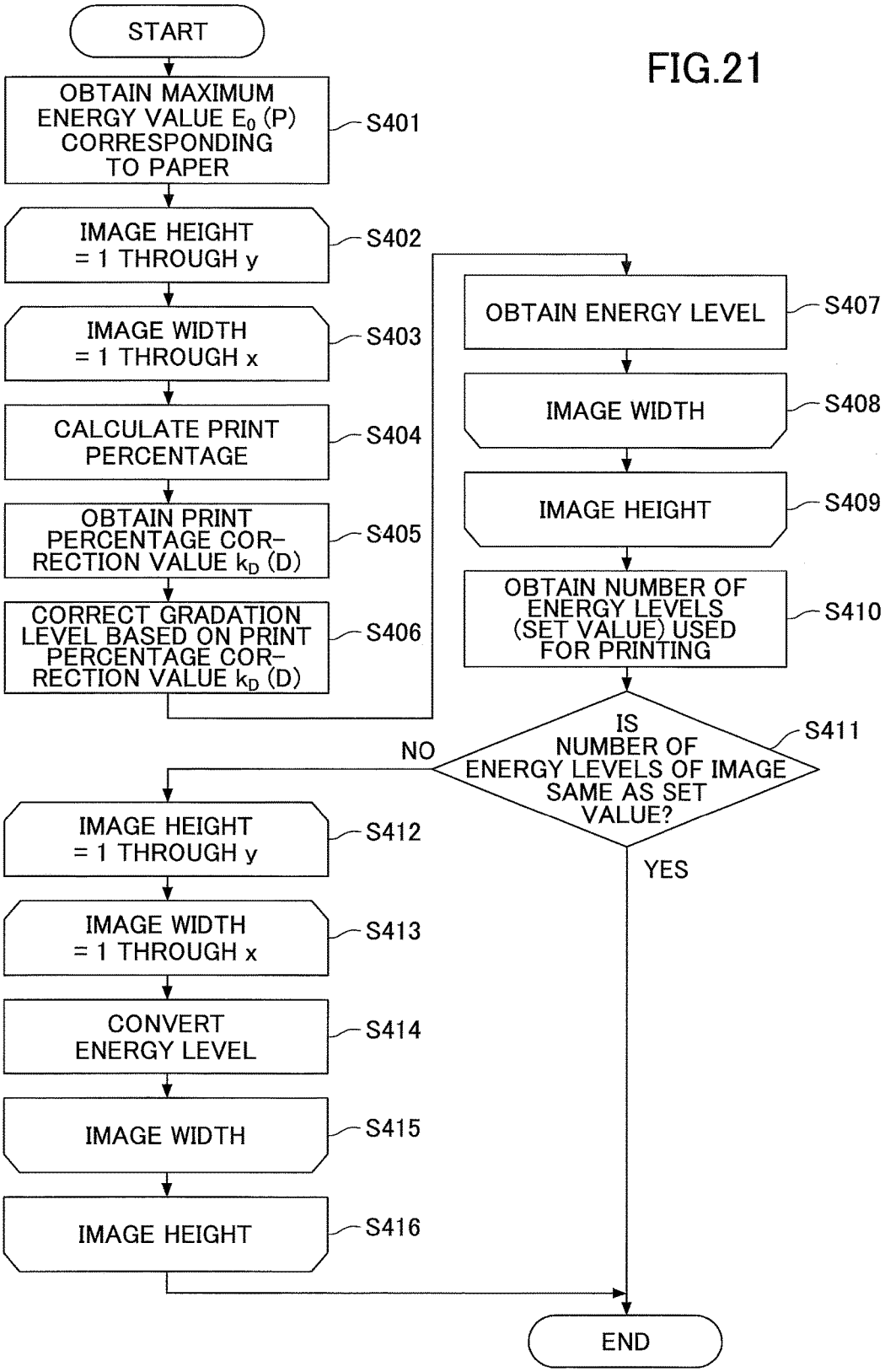
FIG. 21 is a flowchart illustrating an image data process according to a fifth embodiment.
Figure 22:
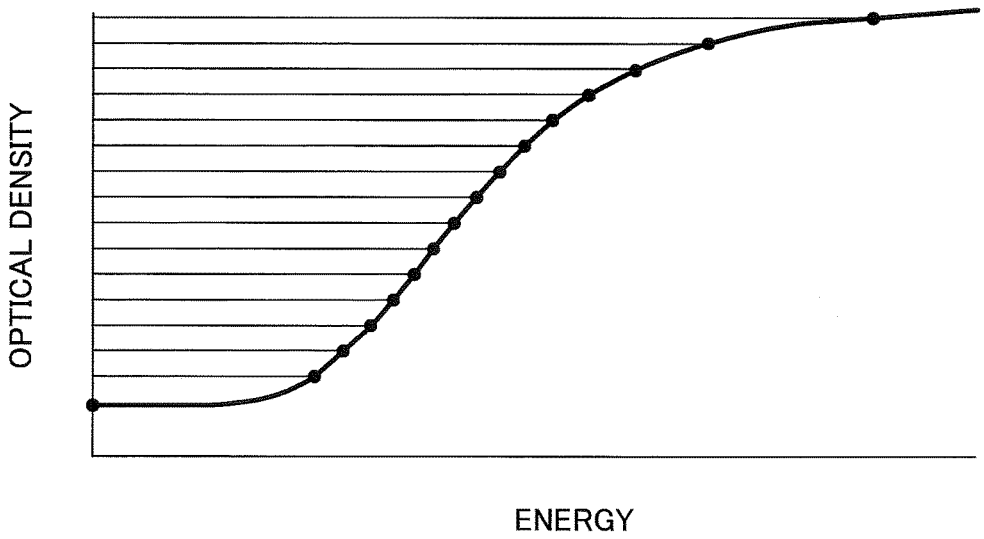
FIG. 22 is a graph illustrating a relationship between optical density and energy applied to heating elements.
Figure 23:
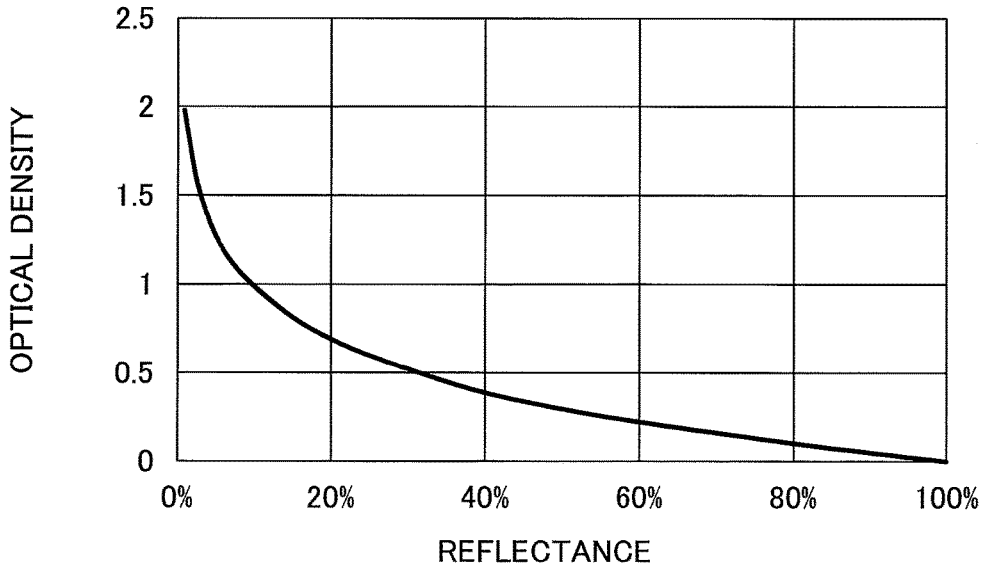
FIG. 23 is a graph illustrating a relationship between optical density and a reflectance of an image.
Figure 24A:
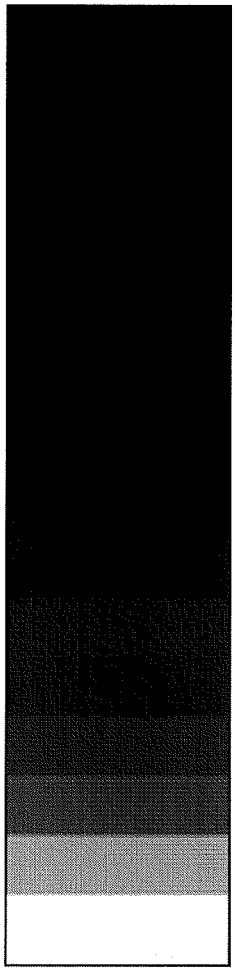
FIGS. 24A and 24B are examples of printed images according to the related-art.
Figure 24B:
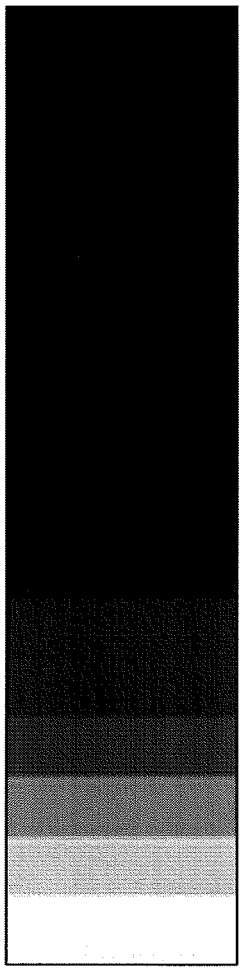

FIG. 21 is a flowchart illustrating an image data process according to the fifth embodiment. When image data is input to the thermal printer 100, a process illustrated in FIG. 21 is performed.

At S401, the MCU 10 obtains a maximum energy value $E_0$ (P) corresponding to the type of paper used for printing from Table 9. Next, the MCU 10 converts gradation levels of an image into energy levels. The MCU repeats S402 through S409 for the number of times corresponding to the height of the image. The MCU 10 repeats S403 through S408 for the number of dots in each print line of the image. When the height of the image is y and the width of the image is x, S402 through S409 are repeated y times, and S403 through S408 are repeated x times for each print line.

At S404, the MCU 10 calculates a print percentage D of two print lines immediately preceding the print dot. Next, at S405, the MCU 10 obtains a print percentage correction value $k_D$ (D) corresponding to the calculated print percentage D from the RAM 11.

At S406, the MCU 10 corrects the gradation level of the print dot based on $k_D$ (D) obtained at S405. At S407, the MCU 10 obtains an energy level corresponding to the gradation level corrected at S406 from a gradation-energy table.

At S410, the MCU 10 obtains the number of energy levels (set value) used for printing. When the number of energy levels of the image is the same as the set value (S411: YES), the MCU 10 ends the process.

When the number of energy levels of the image is different from the set value (S411: NO), the MCU 10 repeats S412 through S416 to convert the energy levels of respective dots in each line of the image. At S414, the MCU 10 obtains a target energy level for each dot in the image using formula (6).

Multiple images with different gradation scales can be printed with the process described above. When image data including a first image with a 4-level gradation scale and a second image with a 16-level gradation scale is to be printed, the entire image can be printed with a 32-level energy scale by converting the original energy levels of the first image in an 8-level energy scale into target energy levels in the 32-level energy scale, or with a 8-level energy scale by converting the original energy levels of the second image in the 32-level energy scale into target energy levels in the 8-level energy scale. The thermal printer of this embodiment can perform high-speed printing. Also, compared with a method where gradation levels are converted, this embodiment improves the gradation reproducibility of the second image.

Even when printing three or more images with different gradation scales onto the same recording medium, all of the images can be printed using an energy scale of one of the images by converting the energy levels of other images into energy levels in the energy scale of the one of the images.

A thermal printer according to embodiments of the present invention is described above. However, the present invention is not limited to the specifically disclosed embodiment, and variations and modifications may be made without departing from the scope of the present invention.

What is claimed is:

1. A thermal printer, comprising:

heating elements that generate heat according to amounts of energy applied thereto;

an energy applier that applies energy to the heating elements;

a memory that stores a gradation table where energy levels to be applied to the heating elements are set for gradation levels based on a relationship between dot area ratios of an image and the amounts of energy applied to the heating elements; and a controller that transfers control data multiple times to the energy applier based on the gradation table to control the amounts of energy to be applied by the energy applier to the heating elements, each of the control data corresponding to different amounts of energy.

2. The thermal printer as claimed in claim 1, wherein the gradation table defines multiple energy levels for each of the gradation levels of a current print dot in a current print line in association with gradation levels of a previous print dot that is located in a previous print line in a same position as the current print dot in a main scanning direction.

3. The thermal printer as claimed in claim 1, wherein the gradation table defines the energy levels such that a print density gradually changes in accordance with the gradation levels regardless of a printing speed.

4. The thermal printer as claimed in claim 1, wherein when a first image with a first gradation scale and a second image with a second gradation scale different from the first gradation scale are to be printed, the controller is configured to convert energy levels of the first image in a first energy scale into energy levels in a second energy scale of the second image.

5. A thermal printer, comprising:

heating elements that generate heat according to amounts of energy applied thereto;

an energy applier that applies energy to the heating elements;

a memory that stores a gradation table where energy values are set for gradation levels based on a relationship between dot area ratios of an image and the amounts of energy applied to the heating elements; and a controller that transfers control data corresponding to gradation levels of a print image to the energy applier based on the gradation table to control the amounts of energy to be applied by the energy applier to the heating elements, wherein when a first image with a first gradation scale and a second image with a second gradation scale different from the first gradation scale are to be printed in a same area, the controller is configured to convert gradation levels of the first image in the first gradation scale into gradation levels in the second gradation scale of the second image.

* * * * *